US007805097B2

(12) United States Patent
Mase et al.

(10) Patent No.: US 7,805,097 B2
(45) Date of Patent: Sep. 28, 2010

(54) DEVELOPING DEVICE AND TONER CARTRIDGE

(75) Inventors: Soichiro Mase, Handa (JP); Takeyuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 423 days.

(21) Appl. No.: 12/022,447

(22) Filed: Jan. 30, 2008

(65) Prior Publication Data

US 2008/0181661 A1 Jul. 31, 2008

(30) Foreign Application Priority Data

Jan. 30, 2007 (JP) ..... 2007-019864

(51) Int. Cl.
*G03G 15/08* (2006.01)

(52) U.S. Cl. ..... 399/258

(58) Field of Classification Search ..... 399/120, 399/113, 119, 258, 262, 263
See application file for complete search history.

(56) References Cited

U.S. PATENT DOCUMENTS 4,641,945 A * 2/1987 Ikesue et al. ..... 399/262
5,028,966 A * 7/1991 Kozuka et al. ..... 399/113
5,568,237 A * 10/1996 Ishida et al. ..... 399/263
5,587,777 A * 12/1996 Miyaji et al. ..... 399/120
5,608,501 A * 3/1997 Makino ..... 399/119
6,738,591 B2 * 5/2004 Hattori et al. ..... 399/119
7,437,095 B2 * 10/2008 Shimomura et al. ..... 399/119
7,574,161 B2 * 8/2009 Ota ..... 399/258
2006/0171744 A1 * 8/2006 Ikeda et al. ..... 399/262

FOREIGN PATENT DOCUMENTS

JP 03175471 A * 7/1991
JP 05241443 A * 9/1993
JP 07-049610 2/1995
JP 07-225514 8/1995

* cited by examiner

*Primary Examiner*—David P Porta
*Assistant Examiner*—Kiho Kim
(74) *Attorney, Agent, or Firm*—Banner & Witcoff, Ltd

(57) ABSTRACT

A developing device includes a developing roller that supplies developer, a developing case that supports the developing roller, a toner cartridge that houses the developer and is attachable to and detachable from the developing case in a direction perpendicular to a longitudinal direction of the developing roller, an abutting member that is swingably provided on the developing case and is abuttable against the toner cartridge from a downstream side in a direction along which the toner cartridge is detached from the developing case, an operating member that is swingably provided on the toner cartridge, and an interlocking member that swings the abutting member between an abutting position and a canceling position, the interlocking member swinging in conjunction with a swinging operation of the operating member, and the toner cartridge being detachable from the developing case when the interlocking member is in the second position.

15 Claims, 14 Drawing Sheets

DEVELOPING DEVICE AND TONER CARTRIDGE

CROSS-REFERENCE TO RELATED APPLICATIONS

This application claims priority from Japanese Patent Application No. 2007-019864 filed on Jan. 30, 2007, the entire subject matter of which is incorporated herein by reference.

TECHNICAL FIELD

Aspects of the present invention relate to a developing device and toner cartridge which are attachable to and detachable from an image forming apparatus such as a laser printer.

BACKGROUND

There has been proposed a developing device of a laser printer in which a toner cartridge is detachably attached to a developing case of the apparatus.

JP-A-7-225514 discloses a developing device in which a toner cartridge is detachably attached to a case of the developing device. Locking guide grooves are formed in the case of the developing device. In the toner cartridge, levers are swingably disposed on a support shaft which is laterally projected from right and left side walls of the toner cartridge, and which rotates a rotary vane. Engaging projections are disposed on level base plates through which the shaft is passed. In JP-A-7-225514, the toner cartridge is attached to the case of the developing device, and the levers are swung about the support shaft to cause the engaging projections to be fitted into the locking guide grooves, whereby the levers and the toner cartridge cannot be disengaged from the case of the developing device. Accordingly, a state of attaching the toner cartridge to the case of the developing device is maintained.

In the developing device disclosed in JP-A-7-225514, positions of fittings between the engaging projections of the toner cartridge and the locking guide grooves of the case of the developing device are located on the right and left sides of the toner cartridge. However, such positions of fittings between the engaging projections of the toner cartridge and the locking guide grooves of the case of the developing device are not located on the downstream side in the direction along which the toner cartridge is detached from the developing case. That is, a member which restricts a relative movement of the toner cartridge attached to the case of the developing device with respect to the case of the developing device is not disposed on the downstream side of the toner cartridge in the detaching direction.

Therefore, when a force of moving the toner cartridge in the detaching direction is applied to the toner cartridge, the toner cartridge may be maintained and may be detached from the case of the developing device.

SUMMARY

Aspects of the invention provide a developing device in which the state of attaching a toner cartridge to a developing case can be surely maintained by a simple operation. Aspects of the invention also provide a toner cartridge which is attachable to and detachable from the developing device.

BRIEF DESCRIPTION OF THE DRAWINGS

FIGS. 10A and 10B are schematic left side sectional views of the toner cartridge of the process cartridge, in which FIG. 10A shows a state where the opening/closing lever is at the abutting position, and FIG. 10B shows a state where the opening/closing lever is at the canceling position;

DETAILED DESCRIPTION

<General Overview>

According to an aspect of the invention, there is provided a developing device including: a developing roller that supplies developer; a developing case that supports the developing roller; a toner cartridge that houses the developer and is attachable to and detachable from the developing case in a direction perpendicular to a longitudinal direction of the developing roller; an abutting member that is swingably provided on the developing case and is abuttable against the toner cartridge from a downstream side in a direction along which the toner cartridge is detached from the developing case; an operating member that is swingably provided on the toner cartridge; and an interlocking member that swings the abutting member between a first position where the abutting member abuts against the toner cartridge provided on the developing case and a second position where the abutting of the abutting member against the toner cartridge is canceled, the interlocking member swinging in conjunction with a swinging operation of the operating member, and the toner cartridge being detachable from the developing case when the interlocking member is in the second position.

According to another aspect of the invention, there is provided a toner cartridge attachable to or detachable from a developing device, the developing device including: a developing case that supports a developing roller; and an abutting member that is swingably provided on the developing case, the toner cartridge being attachable to and detachable from the developing case, the toner cartridge including: a toner case; an operating member that is swingably provided on the toner case; and an interlocking member that swings the abutting member in conjunction with a swinging operation of the operating member so as to abut the abutting member against the toner case to prevent the toner cartridge from being detached from the developing device.

<Illustrative Aspects>

(Laser Printer)

Figure 1:
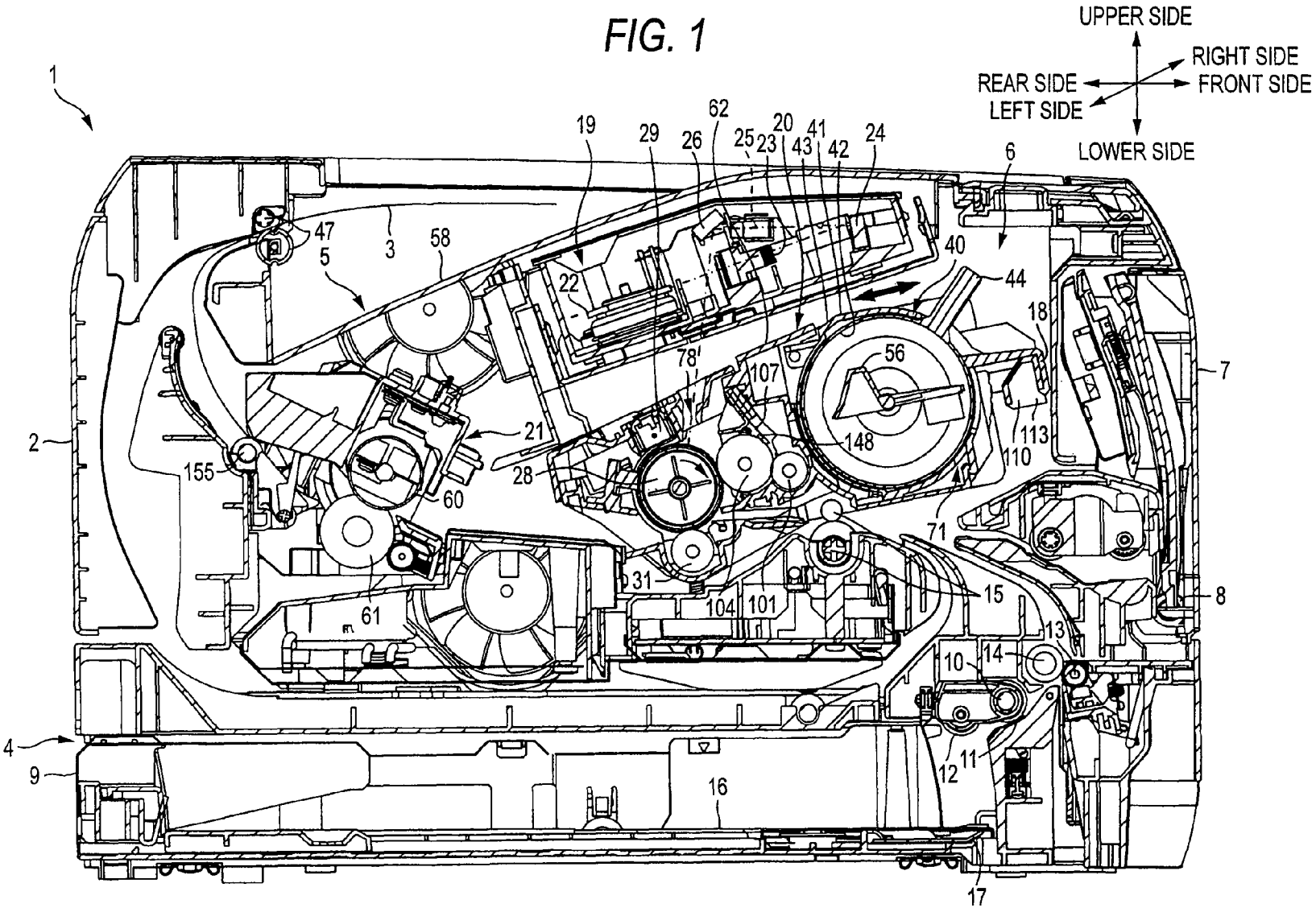
FIG. 1 is an exemplary side sectional view of a laser printer which is an example of the image forming apparatus.

FIG. 1 is an exemplary side sectional view showing a laser printer which is an example of the image forming apparatus of the invention.

As shown in FIG. 1, the laser printer 1 includes a body casing 2, a feeder portion 4 which feeds a sheet 3 housed in the body casing 2 and an image forming unit 5 which forms an image on the fed sheet 3. The body casing 2 is an example of the body of the image forming apparatus.

(1) Body Casing

In one side wall of the body casing 2, an access port 6 is formed through which a process cartridge 20 is passed during operations of attaching and detaching the process cartridge 20. A front cover 7 which openably covers the access port 6 is disposed. The process cartridge 20 is an example of a developing device (described later).

In the following description, the side where the front cover 7 is disposed in a state where the process cartridge 20 is attached to the body casing 2 is referred to as the front side (front face side), and the opposite side is referred to as the rear side (back face side). The front side in a thickness direction of the paper sheet of FIG. 1 is referred to as the left side, and the back side in the thickness direction of the paper sheet of FIG. 1 is referred to as the right side. The right and left direction may be referred to as a width direction.

The front cover 7 is swingably supported by a cover shaft 8, which is disposed in a lower end portion of the front cover 7. When the front cover 7 is closed with setting the cover shaft 8 as a fulcrum, the access port 6 is covered by the front cover 7. When the front cover 7 is opened with setting the cover shaft 8 as a fulcrum, the access port 6 is opened. Accordingly, the process cartridge 20 can be attached to and detached from the body casing 2 through the access port 6.

(2) Feeder Portion

The feeder portion 4 is disposed in a bottom portion of the body casing 2. The feeder portion 4 includes a sheet feed tray 9, a separating roller 10, a separation pad 11, a sheet feed roller 12, a paper dust removing roller 13, a pinch roller 14 and a registering roller 15.

The sheet feed tray 9 includes a sheet press plate 16 therein and a lever 17 in a front portion thereof. A front portion of the sheet press plate 16 is raised by the lever 17.

Sheets 3 stacked on the sheet press plate 16 is conveyed to a separation position between the separating roller 10 and the separation pad 11 by rotation of the sheet feed roller 12, separated one by one at the separation position, and passed between the paper dust removing roller 13 and the pinch roller 14 to be conveyed toward the registering roller 15.

The sheet 3 conveyed to the registering roller 15 is further conveyed to a transferring position between a photosensitive drum 28, which is an example of a photosensitive member (described later), and a transfer roller 31.

(3) Image Forming Unit

The image forming unit 5 includes a scanner portion 19, a process cartridge 20 and a fixing portion 21.

(a) Scanner Portion

The scanner portion 19 is disposed in an upper portion of the body casing 2. The scanner portion 19 includes a laser light source (not shown), a polygon mirror 22 that is rotatingly driven, an fθ lens 23, a reflecting mirror 24, a lens 25 and a reflecting mirror 26. As indicated by a chain line, a laser beam which is emitted from the laser light source on the basis of image data is deflected by the polygon mirror 22, and passed through the fθ lens 23, and the optical path is folded back by the reflecting mirror 24. The laser beam is passed through the lens 25, and the optical path is further downward folded back by the reflecting mirror 26, whereby the laser beam irradiates the surface of the photosensitive drum 28 of the process cartridge 20.

(b) Process Cartridge

Figure 2:
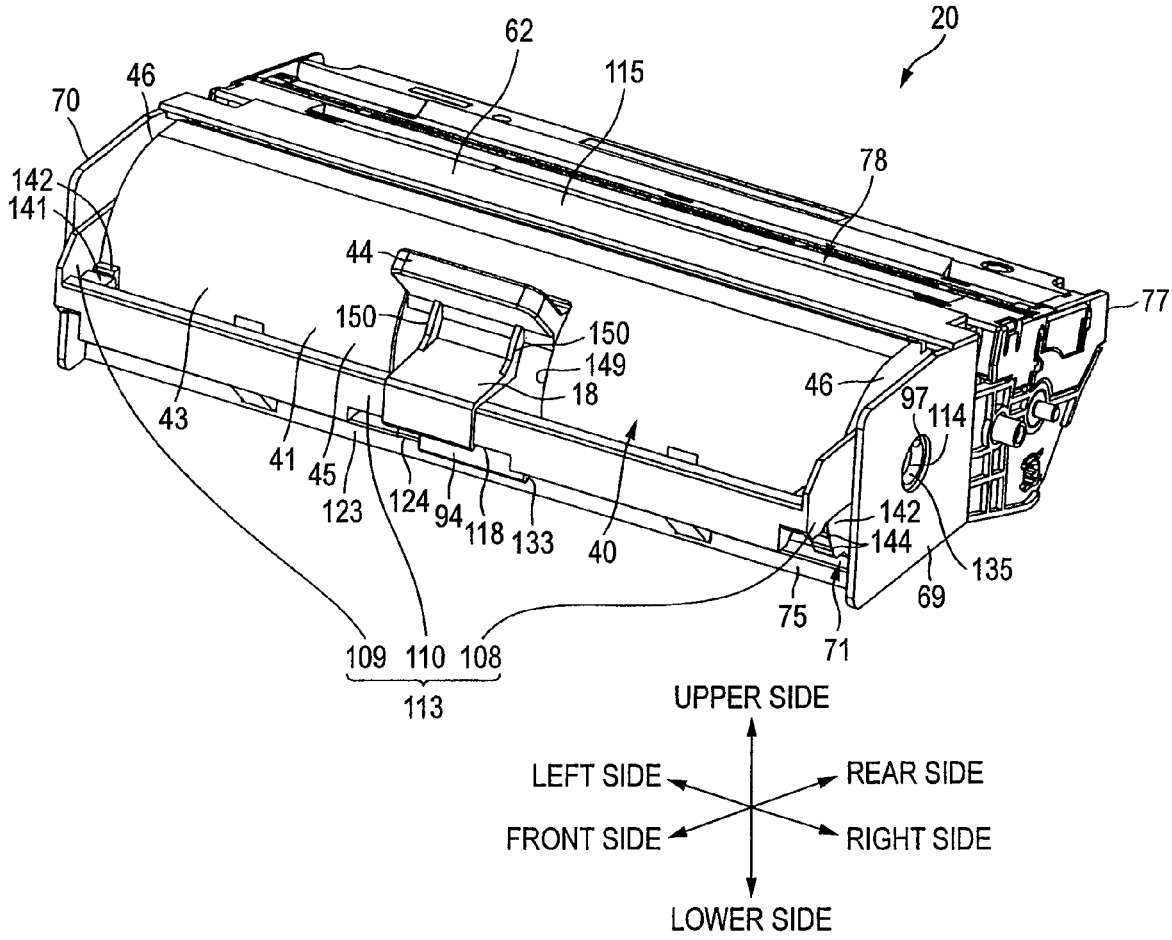
FIG. 2 is an exemplary right side perspective view of a process cartridge in the laser printer shown in FIG. 1, as viewed from a front upper side.
Figure 3:
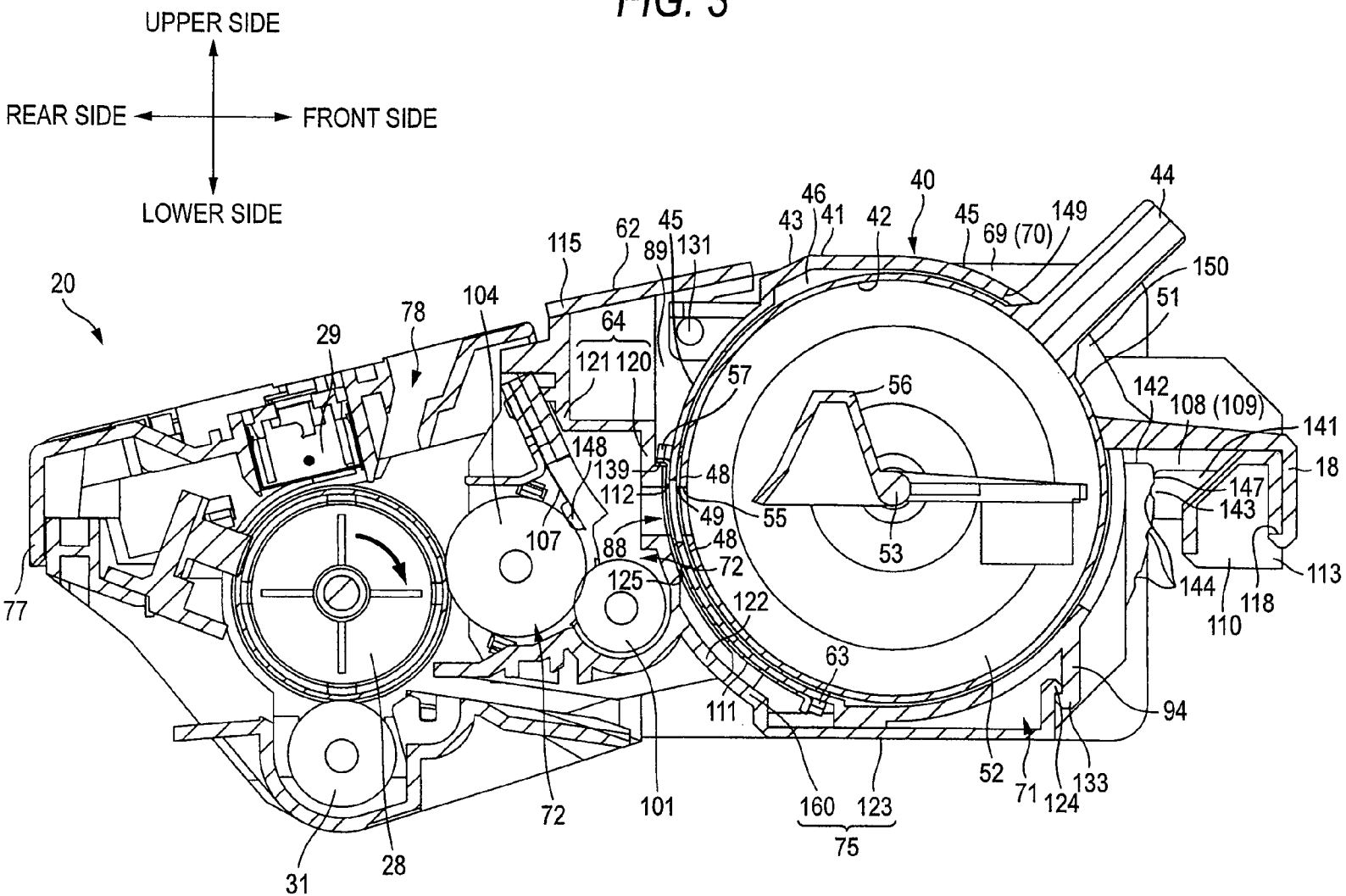
FIG. 3 is an exemplary left side sectional view of the process cartridge of FIG. 2.

FIG. 2 is an exemplary right side perspective view of the process cartridge in the laser printer shown in FIG. 1, as viewed from the front upper side. FIG. 3 is an exemplary left side sectional view of the process cartridge of FIG. 2.

Figure 4A:
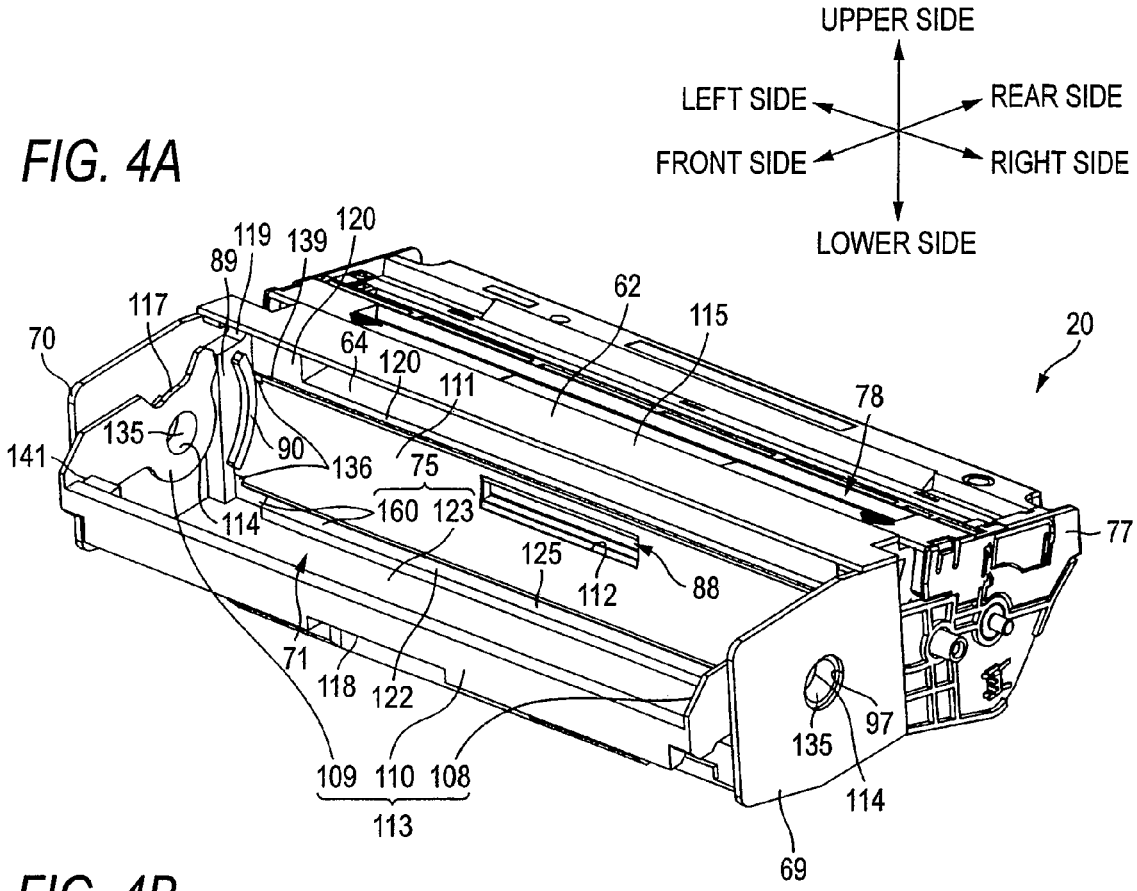
FIG. 4A is a schematic view of the process cartridge showing a state where an opening/closing lever is at an abutting position in FIG. 2.
Figure 4B:
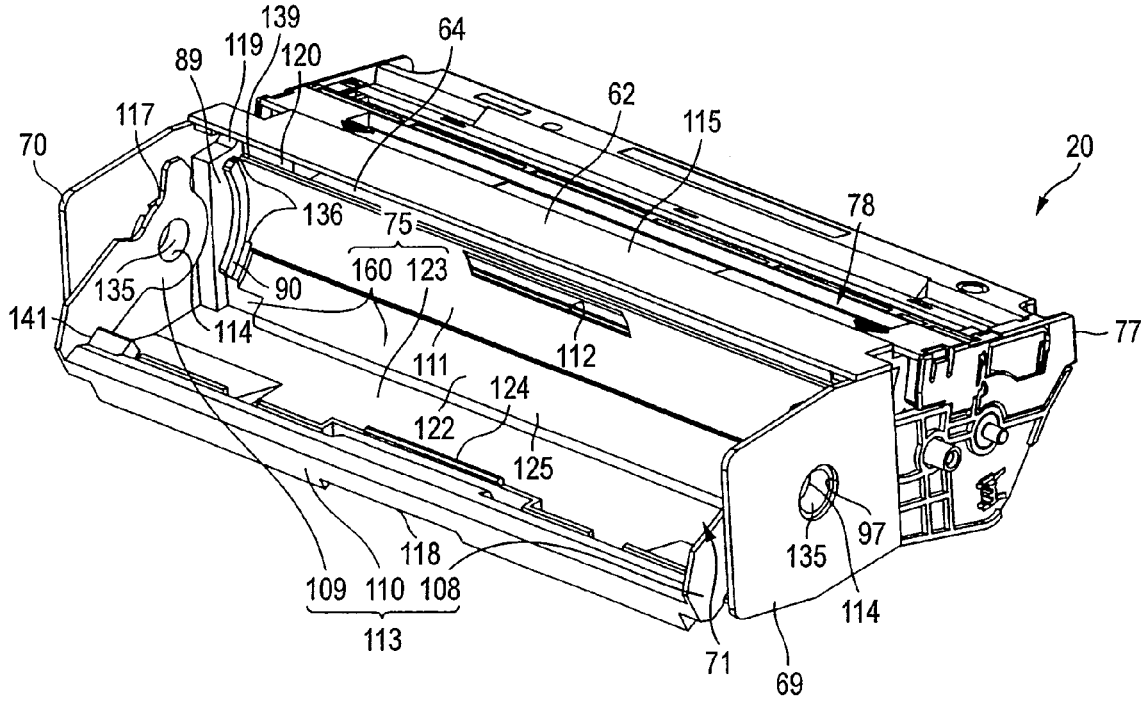
FIG. 4B is a schematic view showing a state where the opening/closing lever is at a canceling position in FIG. 4A.

FIG. 4A is a schematic view of the process cartridge showing a state where a toner cartridge is removed away from the process cartridge in FIG. 2, and an opening/closing lever is at an abutting position to open a toner introduction port. FIG. 4B is a schematic view showing a state where the opening/closing lever is at a canceling position to close the toner introduction port in FIG. 4A.

Figure 5A:
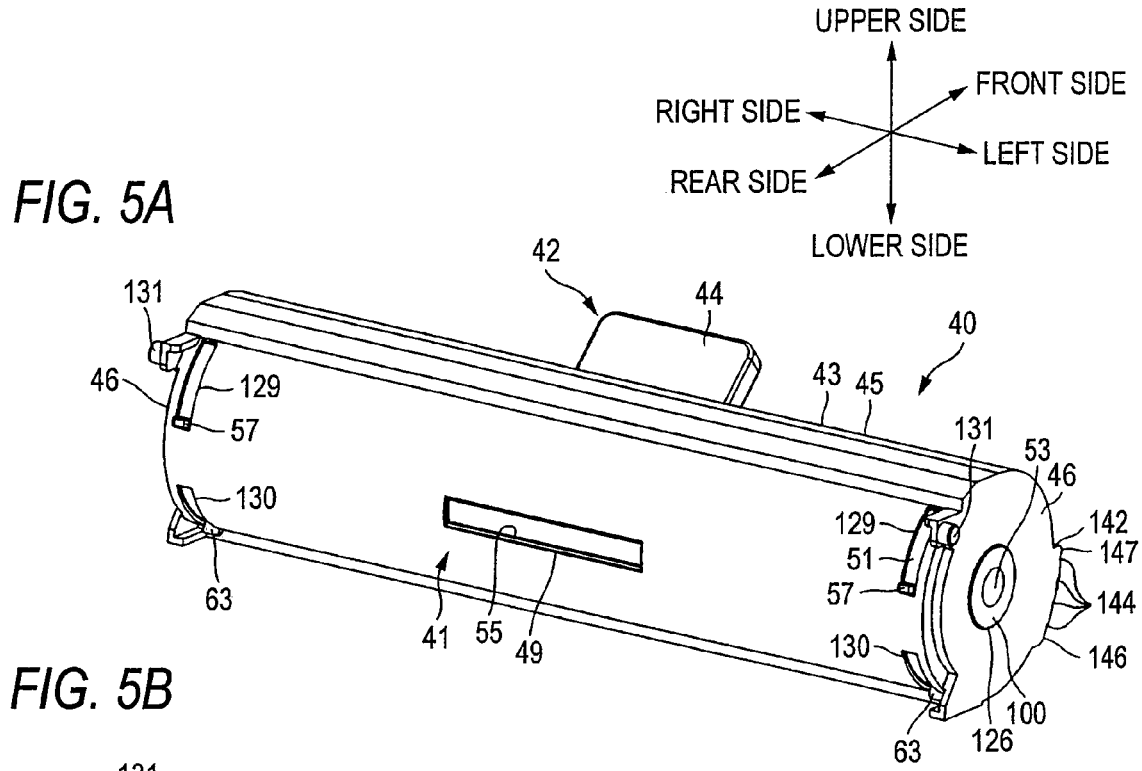
FIG. 5A is an exemplary left side perspective view of the toner cartridge of the process cartridge as viewed from a rear upper side and showing a state where a toner discharging port is opened.
Figure 5B:
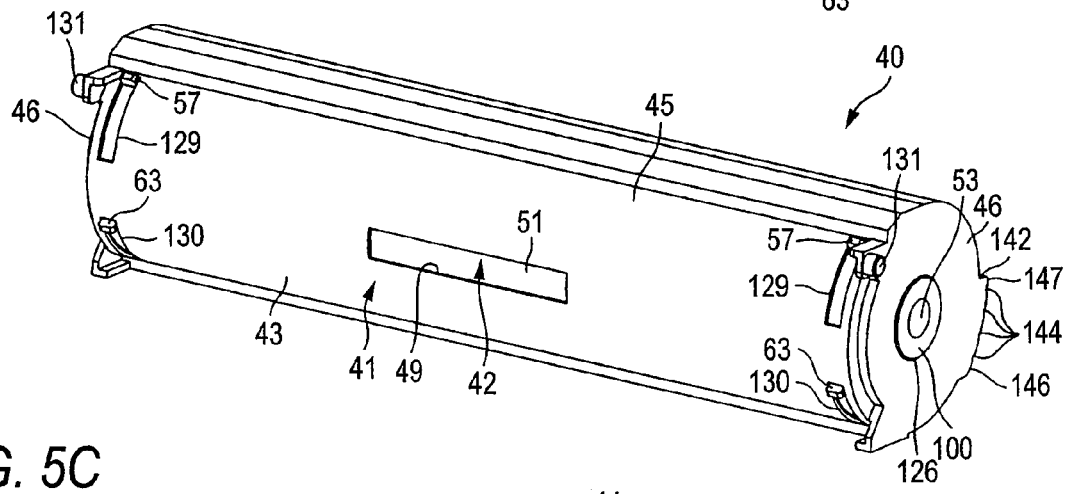
FIG. 5B is an exemplary left side perspective view showing a state where the toner discharging port is closed in FIG. 5A.
Figure 5C:
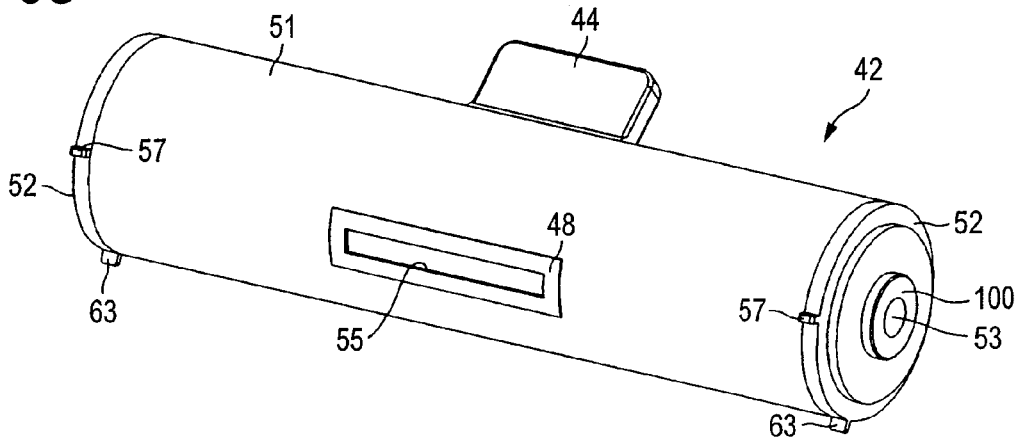
FIG. 5C is an exemplary left side perspective view of an inner case of the toner cartridge shown in FIG. 5A as viewed from the rear upper side.

FIG. 5A is an exemplary left side perspective view of the toner cartridge of the process cartridge shown in FIG. 2, as viewed from the rear upper side, and showing a state where a toner discharging port is opened. FIG. 5B is an exemplary left side perspective view showing a state where, in FIG. 5A, the toner discharging port is closed. FIG. 5C is an exemplary left side perspective view of an inner case of the toner cartridge shown in FIG. 5A, as viewed from the rear upper side.

Figure 6:
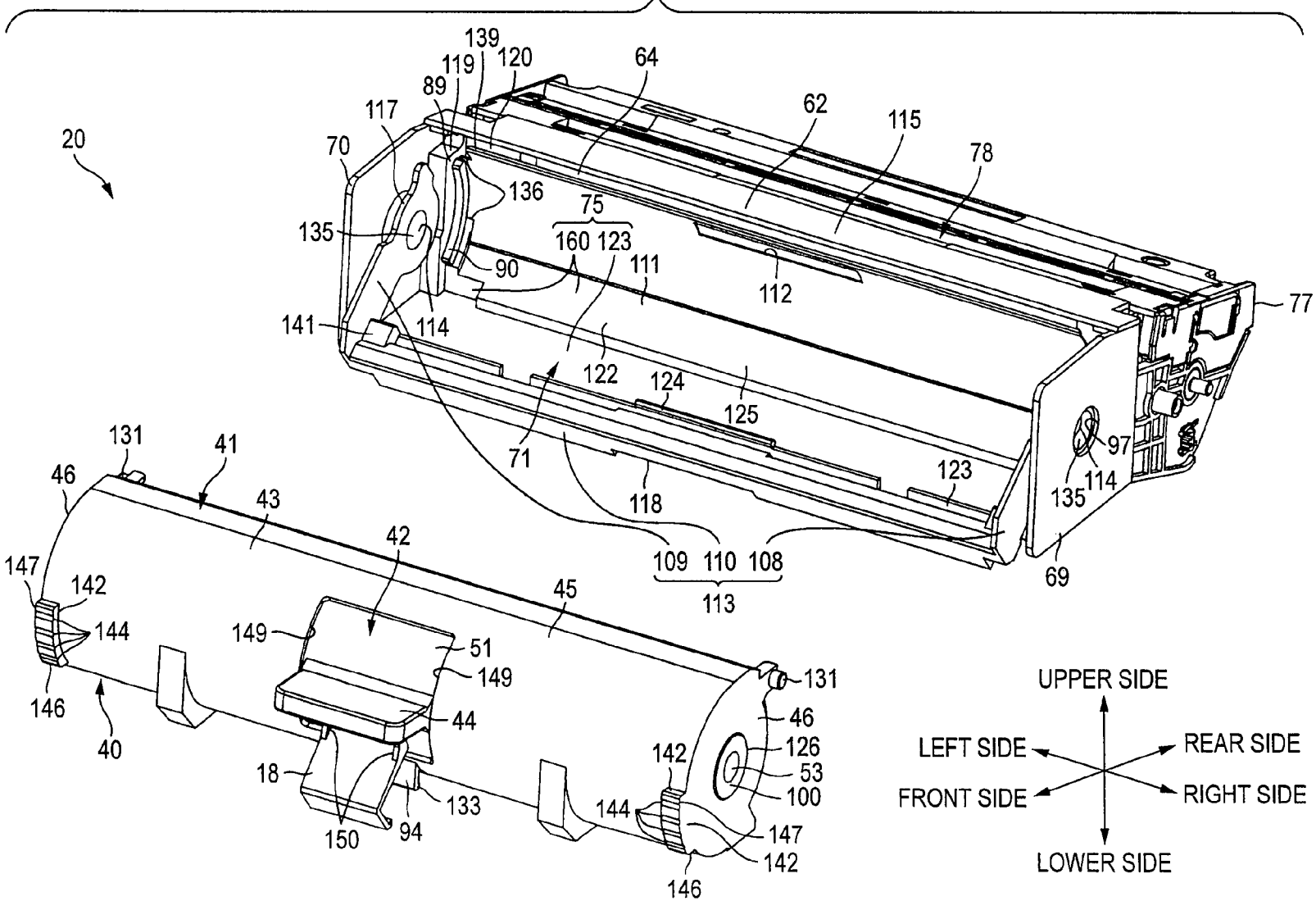
FIG. 6 is an exemplary view showing a state where, in FIG. 2, the toner cartridge is detached and the opening/closing lever is at the canceling position, together with the detached toner cartridge.
Figure 7:
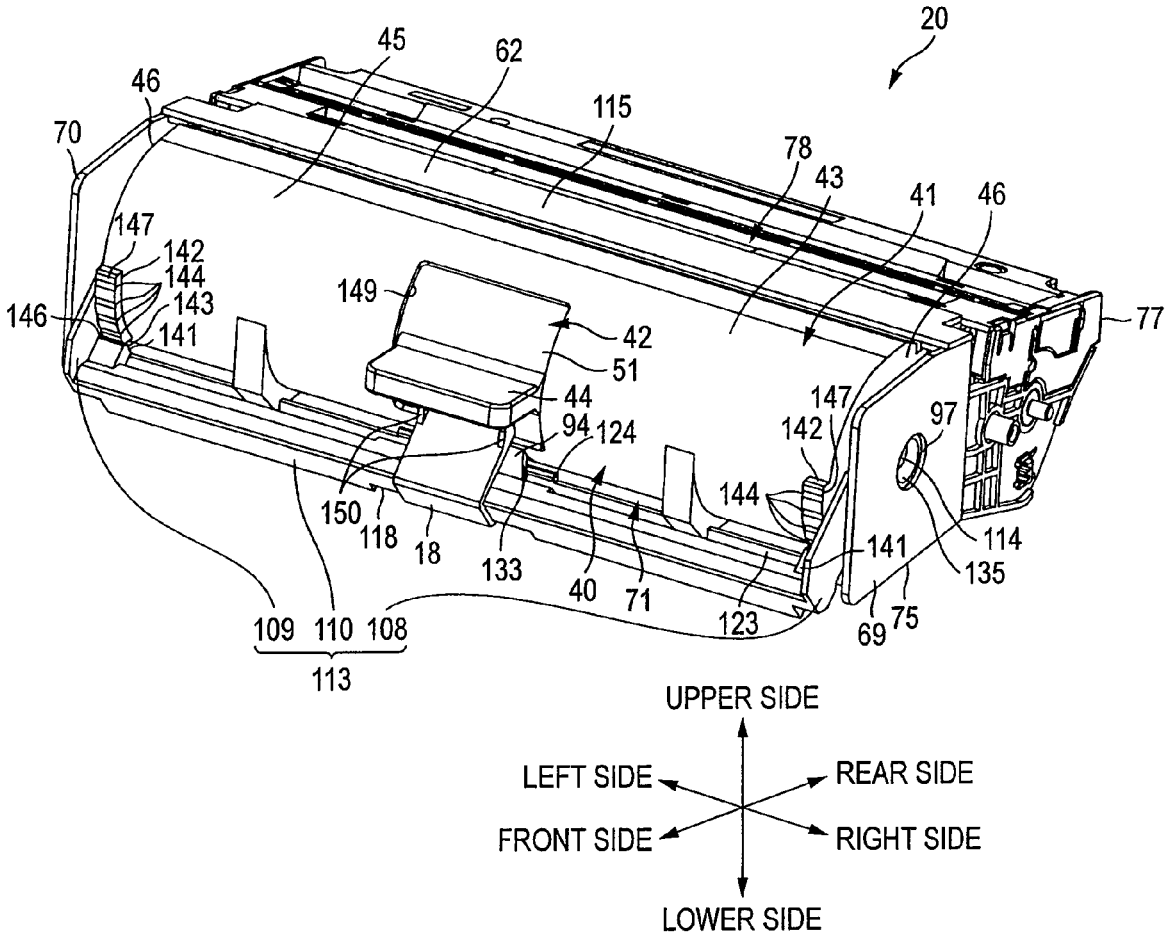
FIG. 7 is an exemplary view showing a state where, in FIG. 2, the opening/closing lever is at the canceling position.

FIG. 6 shows a state where the toner cartridge is detached and the opening/closing lever is at the canceling position in FIG. 2, together with the detached toner cartridge. FIG. 7 shows a state where the opening/closing lever is at the canceling position in FIG. 2.

Figure 8:
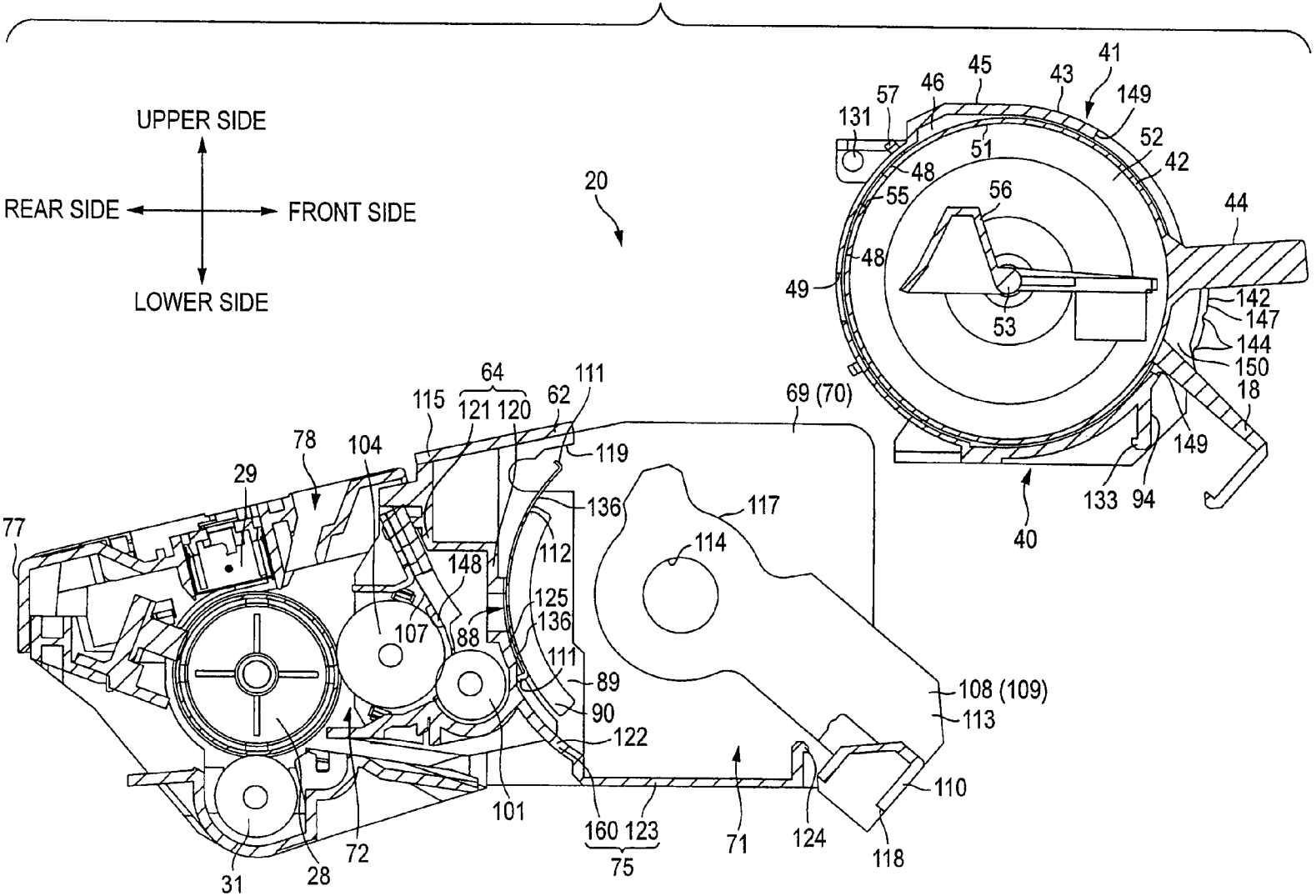
FIG. 8 is an exemplary left side sectional view of the process cartridge of FIG. 6.
Figure 9:
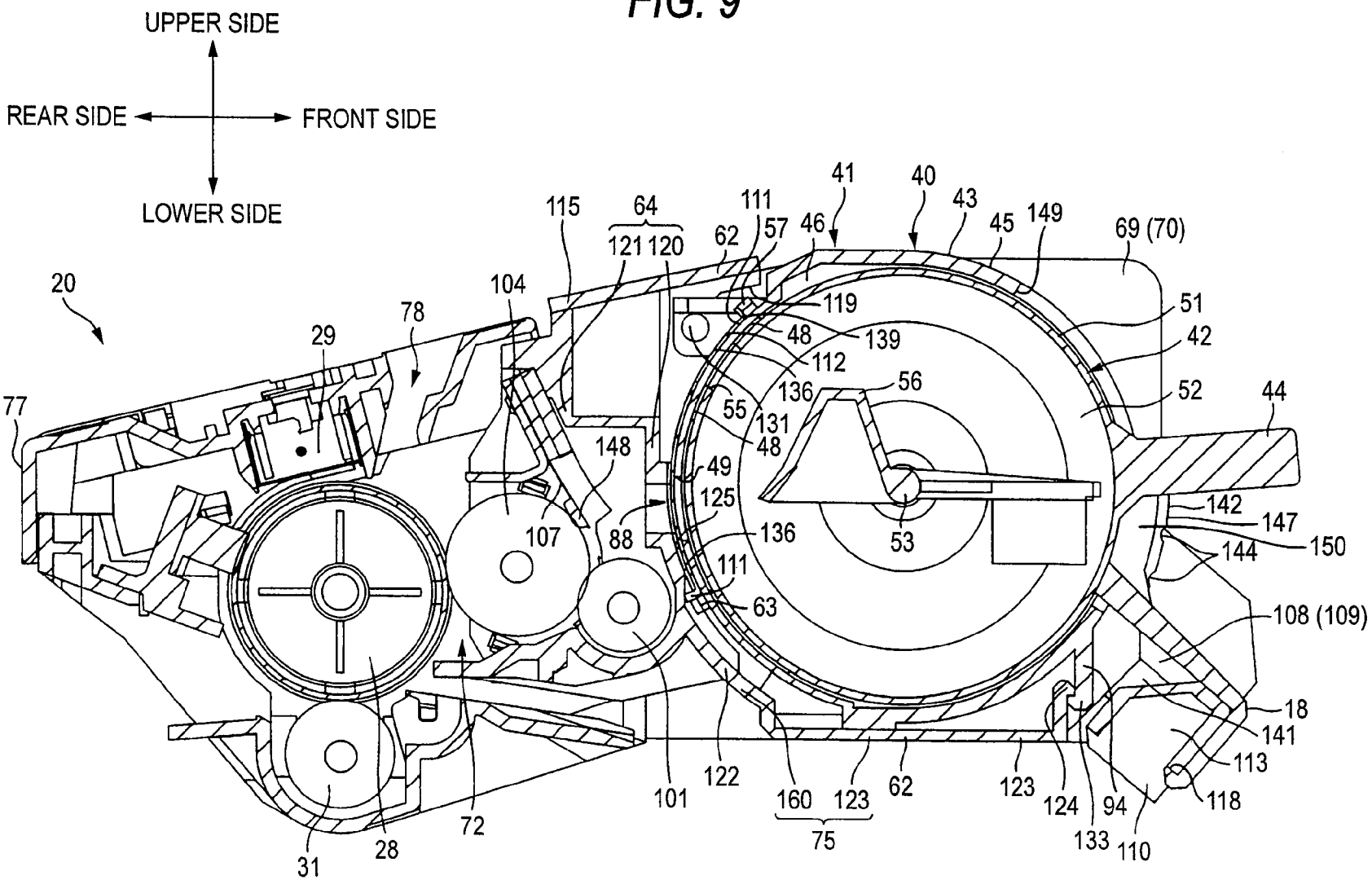
FIG. 9 is an exemplary left side sectional view of the process cartridge of FIG. 7.
Figures 10A, 10B:
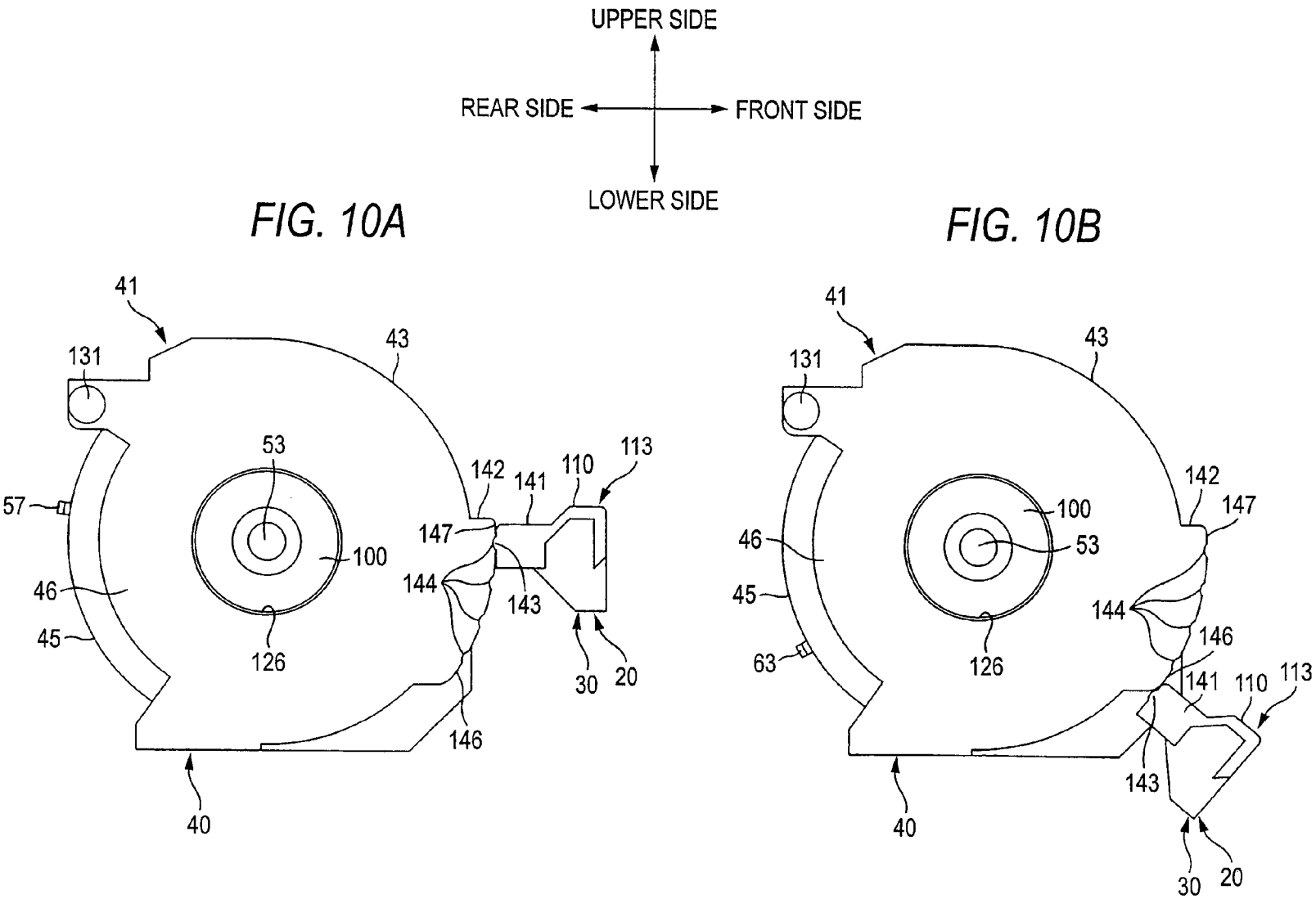

FIG. 8 is an exemplary left side sectional view of the process cartridge of FIG. 6. FIG. 9 is an exemplary left side sectional view of the process cartridge of FIG. 7. FIGS. 10A and 10B are exemplary left side sectional views of the toner cartridge of the process cartridge at a position where an abutted portion of the toner cartridge and an abutting portion of a lever-side gripping portion can be seen. FIG. 10A shows a state where the opening/closing lever is at the abutting position. FIG. 10B shows a state where the opening/closing lever is at the canceling position.

As shown in FIG. 1, the process cartridge 20 is disposed below the scanner portion 19 in the body casing 2. The process cartridge 20 is detachably attached to the body casing 2 through the access port 6. As indicated by the thick arrow in the figure, directions of attaching/detaching the process cartridge 20 with respect to the body casing 2 are a rearward and obliquely downward direction (attaching direction) and a forward and obliquely upward direction (detaching direction).

As shown in FIG. 2, the process cartridge 20 includes a developing case 62 and a toner cartridge 40. The toner cartridge 40 is detachably attached to the developing case 62. As shown in FIG. 3, the process cartridge 20 further includes, in the developing case 62, the photosensitive drum 28, a scorotron charging device 29, the transfer roller 31, a supplying roller 101, a developing roller 104 and a layer-thickness restricting blade 107.

(b-1) Developing Case

As shown in FIG. 2, a right side wall 69, a left side wall 70, a bottom wall 75, a rear side wall 77, a top wall 115 and a front side wall 64 (see FIG. 3) are integrally formed in the developing case 62.

The right and left side walls 69, 70 are opposed to each other in the width direction with forming a space therebetween. In each of the right and left side walls 69, 70, a first passage hole 70 which is passed through the right or left side wall 69, 70 in the width direction is formed in an intermediate portion in the forward and rearward direction.

The rear side wall 77 extends between the rear edges of the right and left side walls 69, 70.

The top wall 115 extends between the rear upper edges of the right and left side walls 69, 70. That is, the top wall 115 do not extend between the front upper edges of the right and left side walls 69, 70, and the upper side is opened in the front side of the developing case 62. A laser entrance hole 78 which allows the laser beam from the scanner portion 19 to be incident on the photosensitive drum 28 is formed in an intermediate portion in the forward and rearward direction of the top wall 115.

The front side wall 64 extends between the right and left side walls 69, 70. As shown in FIG. 3, the front side wall 64 integrally includes a vertical wall 120 and a bent wall 121. The vertical wall 120 extends upward from an intermediate portion in the forward and rearward direction of the bottom wall 75. The bent wall 121 is bent rearward from the upper edge of the vertical wall 120 and is again bent to upward extend to be connected to an intermediate portion in the forward and rearward direction of the top wall 115. The vertical wall 120 is formed such that the portion extending from the portion connected to the bottom wall 75 to an intermediate portion has a substantially inferior arc shape.

The bottom wall 75 extends between the lower edges of the right and left side walls 69, 70. A substantially front half of the bottom wall 75 integrally includes a first bottom wall portion 160 that is connected to the vertical wall 120 and a second bottom wall portion 123 that forward extends from the front edge of the first bottom wall portion 160. The first bottom wall portion 160 is formed such that a side section exhibits a substantially inferior arc shape, and the front edge of the portion is connected to the rear edge of the second bottom wall portion 123. The second bottom wall portion 123 has a substantially L-like side sectional shape that forward extends from the rear edge and is bent to extend upward. In a middle portion in the width direction of a front and upper end portion of the second bottom wall portion 123, an engaged portion 124 is integrally formed in a substantially middle portion in the width direction of a front and upper end portion of the second bottom wall portion 123. The engaged portion 124 has a substantially hook-like sectional shape in a side view which is bent at the upper edge of the second bottom wall portion and slightly extends forward.

Hereinafter, the substantially inferior arc portion of the vertical wall 120 and the first bottom wall portion 160 may be collectively referred to as a curved wall 122 (see FIG. 3).

As shown in FIG. 4A, a square column 89 is integrally formed on a width-direction inner side face of each of the right and left side walls 69, 70 and in the vicinity of a connecting position with respect to the vertical wall 120. The square column 89 has a substantially rectangular parallelepiped shape which is vertically elongated. A guide groove 119 in which a front end face is rearward recessed is formed in an upper end portion of the square column. A rib 90 is integrally formed on a width-direction inner side face of the square column 89 and below the guide groove 119. The rib 90 is projected to the inner side of the width direction such that a side sectional shape exhibits a substantially inferior arc shape. As shown in FIG. 8, the rib is placed so as to substantially extend along the curved wall 122 while forming a small gap in a radial direction with respect to the curved wall 122.

In the developing case 62, a portion defined by the right side wall 69, the left side wall 70, the front side wall 64 and the first and second bottom wall portions 160, 123 of the bottom wall 75 is configured as a toner cartridge housing chamber 71 for housing the toner cartridge 40. The toner cartridge housing chamber 71 has a substantially bottomed frame-like shape in which the upper and front sides are opened.

The toner introduction port 88 is formed at the middle position in the width direction of the vertical wall 120. The toner introduction port 88 is an example of a second opening that penetrates through the vertical wall 120 in the thickness direction. The toner introduction port 88 has a substantially rectangular shape which is elongated in the width direction. The toner introduction port 88 causes the toner cartridge housing chamber 71 to communicate with a developing chamber 72. The developing chamber 72 is a portion defined by the right side wall 69, the left side wall 70, the front side wall 64 and the photosensitive drum 28.

The photosensitive drum 28 is rotatably supported between the right and left side walls 69, 70. The surface most layer is formed by a positive charging photosensitive layer.

The scorotron charging device 29 is supported by the top wall 115 on an obliquely upper rear side of the photosensitive drum 28. The scorotron charging device 29 is disposed so as to oppose to the photosensitive drum 28 with forming a gap so as not to be contacted therewith.

The transfer roller 31 is disposed below the photosensitive drum 28. The transfer roller 31 is placed so as to be vertically opposed to and contacted with the photosensitive drum 28 to form a nip between the roller and the photosensitive drum 28. The nip functions as the transferring position between the photosensitive drum 28 and the transfer roller 31. The transfer roller 31 is rotatably supported between the right and left side walls 69, 70.

The supplying roller 101 is placed in rear of and obliquely below the toner introduction port 88. The supplying roller 101 is rotatably supported between the right and left side walls 69, 70.

The developing roller 104 is elongated in the width direction. The developing roller 104 is placed in rear of and obliquely above the supplying roller 101 in a state where the developing roller is contacted with the supplying roller 101 so as to be mutually compressed. The developing roller 104 is rotatably supported between the right and left side walls 69, 70. The developing roller 104 is placed in front of the photosensitive drum 28 so as to be opposingly contacted therewith.

The layer-thickness restricting blade 107 is configured by a plate spring member and includes a pressing portion 148 having a substantially semicircular section shape, in a free end portion. A basal end portion of the layer-thickness restricting blade 107 is supported above the developing roller 104 by the developing case 62 in order to press contact the pressing portion 148 onto the developing roller 104 by the elastic force of the layer-thickness restricting blade 107.

(b-2) Shutter

The toner cartridge housing chamber 71 includes a shutter 111. The shutter 111 is an example of a second blocking member.

The shutter 111 is a thin plate formed as an inferior arc in which the peripheral length is slightly shorter than the curved wall 122, in a side sectional view. As shown in FIG. 4B, a through hole 112 is formed at the middle position in the width direction of the upper half of the shutter 111. The through hole 112 has a substantially rectangular shape in a front view and penetrates through the shutter 111 in the width direction. Cutaway portions 136, which are cut away in a substantially L-like shape in a front view, are formed in upper and lower end portions of both end portions in the width direction of the shutter 111, respectively. In the upper end portion of the shutter 111, engaged portions 139 which are to be engaged respectively with second radial projections 57 of the toner cartridge 40 in a state where the toner cartridge 40 is attached to the process cartridge 20 are disposed in inner sides in the width direction with respect to the cutaway portions 136, respectively.

As shown in FIG. 8, inside the toner cartridge housing chamber 71, both width-direction end portions of the shutter 111 are interposed between the curved wall 122 and the ribs 90 of the square column 89. Accordingly, the shutter 111 is swingably supported along the side section shapes of the ribs 90 between the right and left side walls 69, 70.

The shutter 111 is swingable between a development closing position (see FIG. 8) and a development opening position (see FIG. 3). In the development closing position, the toner introduction port 88 is closed by a portion of the shutter 111 in which the through hole 112 is not formed. In the development opening position, the through hole 112 is opposed to the toner introduction port 88 in order to open forward the toner introduction port 88. In a state where the toner cartridge 40 (described later) is detached from the developing case 62 (see FIG. 8), the shutter 111 is positioned at the development closing position in order to restrict swinging operation of the shutter.

A seal member 125 is interposed between the curved wall 122 and the shutter 111. The seal member 125 made of felt or the like and having a substantially sheet-like shape is applied to the front side face of the curved wall 122 so as not to close the toner introduction port 88.

(b-3) Opening/Closing Lever

The toner cartridge housing chamber 71 includes the opening/closing lever 113. The opening/closing lever 113 is an example of an abutting member.

As shown in FIG. 4A, the opening/closing lever 113 has a substantially U-like shape in a plan view. A right supporting portion 108, a left supporting portion 109 and a lever gripping portion 110 are integrally formed in the opening/closing lever 113.

The right and left supporting portions 108, 109 are formed as a thin plate having a substantially P-like shape in a right side view. A circular hole 114 penetrating through the right or left supporting portion 108 or 109 in the thickness direction is formed at a substantially middle position of the rear half portion of each of the right and left supporting portions 108, 109.

In the outer side face in the width direction of each of the right and left supporting portions 108, 109, a support cylinder 135 having the substantially same inner diameter as the circular hole 114 is provided at a position corresponding to the circular hole 114. The support cylinder 135 is projected to the outside in the width direction. The outer diameter of the support cylinder 135 is slightly smaller than the inner diameter of a first through hole 97 formed in each of the right and left side walls 69, 70.

A receiving portion 117 is formed above the circular hole 114 of each of the right and left supporting portions 108, 109. An upper edge of the receiving portion 117 is recessed toward the circular hole 114 in a substantially U-like shape in a side view.

The lever gripping portion 110 is stretched between front end portions of the right and left supporting portions 108, 109, in a front view. The lever gripping portion 110 has a thin plate having a substantially rectangular shape. A grip portion 118 in which the lower edge is upward recessed is formed at the middle position in the width direction of the lever gripping portion. In the lever gripping portion 110, abutting projections 141 are formed in both wide-direction end portions of the side faces on the sides of the circular holes 114, respectively. The abutting projections 114 are projected toward the respective circular holes 114 and have a substantially rectangular parallelepiped shape. As shown in FIGS. 10A and 10B, an abutting portion 143 is disposed in a side face (rear side face) of each of the abutting projections 141 on the side of the circular hole 114. The abutting portion 143 has a substantially convex shape directed toward the circular hole 114 (rear side). Specifically, the abutting portions 143 have a substantially hemispherical shape.

As shown in FIG. 4A, the support cylinders 135 of the right and left supporting portions 108, 109 are internally fitted in the first through holes 97 of the right and left side walls 69, 70, so that the opening/closing lever 113 is swingably supported by the right and left side walls 69, 70. The opening/closing lever 113 is swingable between a canceling position (see FIG. 4B) where the lever gripping portion 110 of the opening/closing lever 113 is positioned below the circular holes 114, and an abutting position (see FIG. 4A) where the lever gripping portion 110 is at the same level as the circular holes 114. The position of the lever gripping portion 110 at the canceling position (see FIG. 10B) is below that where the portion is at the abutting position (see FIG. 10A). In the state where the toner cartridge 40 is not attached to the developing case 62 shown in FIG. 4B, the opening/closing lever 113 is located at the canceling position by its own weight.

Irrespective of the position of the opening/closing lever 113, the grip portion 118 is always exposed to the outside from the toner cartridge housing chamber 71 in a side view as shown in FIG. 3.

(b-4) Toner Cartridge

As described above, the toner cartridge 40 is detachably attached to the toner cartridge housing chamber 71 of the developing case 62. When the process cartridge 20, to which the toner cartridge 40 is attached, is attached to or detached from the body casing 2 through the access port 6, the toner cartridge 40 can be attached to or detached from the body casing 2. In the state where the process cartridge 20 is attached to the body casing 2, the toner cartridge 40 can be attached to or detached from the developing case 62. The toner cartridge 40 alone can be attached to or detached from the body casing 2. The attaching/detaching direction of the toner cartridge 40 with respect to the developing case 62 of the process cartridge 20 is the rearward and obliquely downward direction (attaching direction) and the forward and obliquely upward direction (detaching direction). A direction perpendicular to the attaching/detaching direction of the toner cartridge 40 with respect to the developing case 62 is the width direction.

The toner cartridge housing chamber 71 of the developing case 62 is positioned in front of the process cartridge 20. When the front cover 7 is opened to open the access port 6, the toner cartridge 40 is exposed from the access port 6 as shown in FIG. 1.

As shown in FIG. 3, the toner cartridge 40 includes an outer case 41 and an inner case 42. The outer case 41 has a substantially cylindrical shape and is made of a resin or the like. The inner case 42 is an example of a first blocking member.

(b-4-i) Outer Case

The outer case 41 configures an outer shell of the toner cartridge 40 and includes a cylinder portion 43.

As shown 5A, the cylinder portion 43 is formed as a hollow and substantially cylindrical member which is elongated in the width direction. The cylinder portion 43 includes an outer peripheral wall 45, and a pair of outer side end walls 46 formed as both width-direction end faces of the outer peripheral wall 45.

A first toner discharging port 49 penetrates through the outer peripheral wall 45 in the thickness direction is formed at the middle position in the vertical and lateral directions of the rear side face of the outer peripheral wall 45. The first toner discharging port 49 is an example of a first opening. The first toner discharging port 49 has a substantially rectangular shape elongated in the width direction.

An upper guide groove 129 penetrating through the outer peripheral wall 45 in the thickness direction is formed in each of width-direction end portions of the rear side face of the outer peripheral wall 45 at a level higher than the first toner discharging port 49. A lower guide groove 130 penetrating through the outer peripheral wall 45 in the thickness direction is formed in each of width-direction end portions of the outer peripheral wall 45 at a level lower than the first toner discharging port 49. The upper and lower guide grooves 129, 130 have a substantially rectangular shape in a rear view which is elongated in the circumferential direction. Circumferential lengths of the upper and lower guide grooves 129, 130 are about twice a circumferential length of the first toner discharging port 49, and axial lengths of the upper and lower guide grooves 129, 130 are about one half of the circumferential length of the first toner discharging port 49.

As shown in FIG. 6, an exposing hole 149 is formed at a substantially middle of the front side face of the outer peripheral wall 45. The exposing hole 149 has a substantially rectangular shape in a front view and penetrates through the outer peripheral wall 45 in the thickness direction. A positioning hook 94 is formed integrally with the outer peripheral wall 45 and is disposed below the exposing hole 149 in the front side face of the outer peripheral wall 45. The positioning hook 94 is a thin plate having a substantially rectangular shape in a front view. The positioning hook 94 is formed so as to extend downward substantially vertically from a position which is slightly below the exposing hole 149. An engaging portion 133 is formed in a lower end portion of the positioning hook 94. The engaging portion 133 has a substantially hook-like sectional shape in a left side view in which the lower end portion of the positioning hook 94 is slightly bent to the rear side (see FIG. 3).

Abutted members 142 are disposed in both width-direction end portions of a lower portion of the front side face of the outer peripheral wall 45. Each of the abutted members 142 has a substantially arcuate shape in a left side view in which the member is forward projected from the front side face of the outer peripheral wall 45. The dimension of the member in the width direction is substantially equal to the width of the abutting projection 141 of the opening/closing lever 113. As shown in FIGS. 10A and 10B, the front side face of the abutted member 142 includes a guide face 146 and an abutted face 147. In a left side view, the guide face 146 extends substantially horizontally toward the front side and is smoothly bent on the way so as to be inclined toward an obliquely upper front side. The abutted face 147 is formed so as to upward extend continuously from the upper edge of the guide face 146 and along the front side face of the outer peripheral wall 45. In the abutted face 147, plural abutted portions 144 which have a substantially concave shape directing rearward are disposed in the circumferential direction (vertical direction). Specifically, the abutted portions 144 are formed so as to be recessed in a substantially semispherical shape. Incidentally, although the abutted portions 144 are disposed in a plural number in FIGS. 10A and 10B, only one abutted portion may be disposed.

As shown in FIG. 5A, a second through hole 126 penetrating through each of the outer side end walls 46 in the width direction is formed at a substantially middle position in the vertical and lateral directions of each of the outer side end walls 46.

Positioning projections 131 are integrally formed on the outer side end walls 46, respectively. Each of the positioning projections extends rearward at a position corresponding to the upper edge of the upper guide groove 129 and is bent to be projected to the outside in the width direction. In the positioning projection 131, the portion which is projected to the outside in the width direction has a substantially columnar shape having an outer diameter that is smaller than the width of the guide groove 119 (see FIG. 4A) of the process cartridge 20.

(b-4-ii) Inner Case

As shown in FIG. 5C, the inner case 42 has a substantially hollow cylindrical shape which is elongated in the width direction, and which is smaller than the cylinder portion 43 of the outer case 41. The inner case 42 is integrally formed with an inner peripheral wall 51, a pair of inner side end walls 52; a guide lever 44 which is an example of an operating member and an interlocking hook 18 (see FIG. 6) which is an example of an interlocking member. The inner peripheral wall 51 has a substantially cylindrical shape. The inner side end walls 52 are formed as flat disks which close the both side faces in the width direction of the inner peripheral wall 51. The guide lever 44 and the interlocking hook 18 will be described later.

As shown in FIG. 3, an agitator rotation shaft 53 is stretched between the centers of the inner side end walls 52 that are opposed to each other in the width direction. The agitator rotation shaft 53 is rotatably supported by the inner side end walls 52. As shown in FIG. 3, an agitator 56 is disposed on the agitator rotation shaft 53.

As shown in FIG. 5C, both width-direction end portions of the agitator rotation shaft 53 are projected to the outside in the width direction from the inner side end walls 52, respectively. Collars 100 having an outer diameter that is slightly smaller than the diameter of the second through hole 126 (see FIG. 5A) of the outer case 41 are externally fitted to the projected portions of the agitator rotation shaft 53, respectively.

A second toner discharging port 55 is formed at a circumferential position and at the middle position in the width direction of the inner peripheral wall 51. The second toner discharging port 55 penetrates through the inner peripheral wall 51 in the thickness direction. As viewed from the outer side in a radial direction, the second toner discharging port 55 is formed in a substantially rectangular shape in which the dimensions are substantially identical with those of the first toner discharging port 49 of the outer case 41.

A first radial projection 48 is disposed on the inner peripheral wall 51. The first radial projection 48 extends along the periphery of the second toner discharging port 55 and is projected to the radially outer side. The first radial projection 48 has a substantially rectangular frame-like shape as viewed from the outer side in a radial direction. The first radial projection 48 is formed by an elastic material such as rubber or a sponge sheet.

In both width-direction end portions of the inner peripheral wall 51, the second radial projections 57 projecting to the radially outer side are integrally disposed at positions slightly above the upper edge of the first radial projection 48, respectively. In the both width-direction end portions of the inner peripheral wall 51, third radial projections 63 projecting to the radially outer side are integrally disposed at positions below the lower edge of the first radial projection 48, respectively. The second and third radial projections 57, 63 are formed in the same dimensions. Lengths in the width direction of the second and third radial projections 57, 63 are smaller than the widths of the upper and lower guide grooves 129, 130 of the outer case 41.

As shown in FIG. 3, the interlocking hook 18 is disposed integrally with the inner peripheral wall 51 at the middle in the width direction of the inner peripheral wall 51 and opposite to the second toner discharging port 55 about the axial center of the inner case 42. The guide lever 44 is disposed integrally with the inner peripheral wall 51 at a position of the inner peripheral wall 51 slightly above the interlocking hook 18.

While setting the posture of the toner cartridge 40 in FIG. 3 as a reference, the interlocking hook 18 is a thin plate having a substantially rectangular shape in a plan view, and extends forward substantially horizontally, and then is downward bent and further slightly bent to the rear side. Similarly, while setting the posture of the toner cartridge 40 in FIG. 3 as a reference, the guide lever 44 is a thin plate having a substantially rectangular shape in a plan view and extends substantially perpendicularly to the inner peripheral wall 51 and toward an obliquely upper front side. The dimension in the width direction of the guide lever 44 is larger than that of the interlocking hook 18 and smaller than that of the exposing hole 149 of the outer case 41 (see FIG. 2). Basal end portions of the guide lever 44 and the interlocking hook 18 are coupled to each other by coupling ribs 150. The guide lever 44 and the interlocking hook 18 are disposed as an integral member on the inner peripheral wall 51.

(b-4-iii) Installation of Inner Case Into Outer Case

In the toner cartridge 40, the inner case 42 is housed in the outer case 41, and the width-direction end portions of the agitator rotation shaft 53 of the inner case 42 are internally fitted together with the collars 100 into the second through holes 126 of the outer case 41, respectively, as shown in FIG. 5A.

The second radial projections 57 of the inner case 42 are projected from the upper guide grooves 129 of the outer case 41 toward the radially outer side of the inner case 42. The third radial projections 63 of the inner case 42 are projected from the lower guide grooves 130 of the outer case 41 toward the radially outer side of the inner case 42. The interlocking hook 18 and guide lever 44 of the inner case 42 are projected from the exposing hole 149 of the outer case 41 toward the radially outer side of the inner case 42 (see FIG. 6).

Accordingly, the inner case 42 is installed into the outer case 41 and is swingably supported by the outer side end walls 46 of the outer case 41. The inner case 42 is swung in a clockwise direction or a counterclockwise direction in a left side view, and in a direction intersecting with the attaching/detaching direction of the toner cartridge 40. The second radial projections 57 are slidable along the respective upper guide grooves 129. The third radial projections 63 are slidable along the respective lower guide grooves 130. The interlocking hook 18 and the guide lever 44 are swingable in the exposing hole 149 (see FIG. 6). When the inner case 42 is swung with respect to the outer case 41, as shown in FIG. 5B, the second radial projections 57 are guided by the respective upper guide grooves 129, and the third radial projections 63 are guided by the respective lower guide grooves 130. During the swinging operation of the inner case 42 with respect to the outer case 41, as shown FIG. 3, the first radial projection 48 of the inner case 42 is in sliding contact with the inner side face of the outer peripheral wall 45 of the outer case 41. Accordingly, the interface between the outer case 41 and the inner case 42 can be maintained air-tightly and liquid-tightly.

As shown in FIGS. 5B and 8, the inner case 42 can be moved to a toner closing position where the first toner discharging port 49 of the outer case 41 is closed by a portion of the inner peripheral wall 51 other than the second toner discharging port 55 to hermetically seal the interiors of the outer and inner cases 41, 42. At this time, the second radial projections 57 abut against the upper edges of the respective upper guide grooves 129, the third radial projections 63 abut against the upper edges of the respective lower guide grooves 130, and the interlocking hook 18 is adjacent to the lower edge of the exposing hole 149. In contrast, as shown in FIGS. 3 and 5A, the inner case 42 can be moved to a toner opening position where the first toner discharging port 49 is opposed to the second toner discharging port 55 to open the first toner discharging port 49 and also the interiors of the outer and inner cases 41, 42. At this time, the second radial projections 57 abut against the lower edges of the respective upper guide grooves 129, the third radial projections 63 abut against the lower edges of the respective lower guide grooves 130, and the guide lever 44 is adjacent to the upper edge of the exposing hole 149.

As developer, a nonmagnetic single-component toner having a positive chargeability is housed in the inner case 42.

(b-5) Attachment and Detachment of Toner Cartridge to and from Process Cartridge (b-5-i) Attachment of Toner Cartridge to Process Cartridge The toner cartridge 40 is attached to the toner cartridge housing member 71 of the developing case 62 of the process cartridge 20 from the forward and obliquely upward side to the rearward and obliquely downward side as shown in FIG. 8. When attaching the toner cartridge 30, the inner case 42 is set at the toner closing position, the opening/closing lever 113 is at the canceling position, and the shutter 111 is at the development closing position. At this time, as shown in FIG. 6, the positioning projections 131 of the toner cartridge 40 are guided by the guide grooves 119 in the toner cartridge housing chamber 71 of the process cartridge 20.

When the positioning projections 131 reach and abut against the innermost portions of the guide grooves 119, the second radial projections 57 of the toner cartridge 40 are engaged with the engaged portions 139 of the shutter 111 of the toner cartridge housing chamber 71 as shown in FIG. 9. Then, the shutter 111 is clamped in the swinging direction between the second radial projections 57 and the third radial projections 63.

At this time, the interlocking hook 18 of the toner cartridge 40 is engaged with the grip portion 118 of the opening/closing lever 113 of the process cartridge 20 from the forward and obliquely downward side.

Moreover, the engaging portion 133 of the toner cartridge 40 is engaged with the engaged portion 124 of the toner cartridge housing chamber 71, thereby completing the operation of attaching the process cartridge 20 of the toner cartridge 40 to the developing case 62.

In this state, as shown in FIG. 10B, the abutting portions 143 of the abutting projections 141 of the lever gripping portion 110 of the opening/closing lever 113 are opposed to and slightly contacted with the guide faces 146 of the corresponding abutted members 142 in the toner cartridge 40.

As shown in FIG. 7, the inner case 42 is swingable with respect to the outer case 41 in a state where the attachment of the toner cartridge 40 to the process cartridge 20 is completed. When the guide lever 44 is gripped and upward twisted in this state to be swung, the inner case 42 which integrally includes the guide lever 44 is swung from the toner closing position (see FIG. 9) to the toner opening position (see FIG. 3). As shown in FIG. 3, the first toner discharging port 49 is opened, and the first toner discharging port 49 and the second toner discharging port 55 are opposed to each other. In conjunction with the swinging of the inner case 42, the shutter 111, which is calmed between the second radial projections 57 of the inner case 42 and the third radial projections 63, is swung from the development closing position (see FIG. 9) to the development opening position (see FIG. 3). As a result, the toner introduction port 88 is opened, and the through hole 112 of the shutter 111 is opposed to the toner introduction port 88 of the toner cartridge housing chamber 71. In this way, the operation of opening the toner introduction port 88 by the shutter 111 is performed through the operation in which the first toner discharging port 49 is opened by the inner case 42.

Similarly with the guide lever 44, the interlocking hook 18 is integrally disposed on the inner case 42. Thus, the interlocking hook 18 is swung together with the guide lever 44 and the inner case 42. Then, the opening/closing lever 113, in which the grip portion 118 is engaged with the interlocking hook 18, is swung from the canceling position to the abutting position (see FIG. 2) in accordance with the swinging of the interlocking hook 18. That is, the interlocking hook 18 swings the opening/closing lever 113 in conjunction with the swinging of the guide lever 44. In this way, the swinging operation of the opening/closing lever 113 is interlocked with the opening operations of the inner case 42 and the shutter 111.

In the toner cartridge housing chamber 71 in which the shutter 111 is at the development opening position, the through hole 112 and toner introduction port 88 are in the opposed state. In the toner cartridge 40 in which the inner case 42 is at the toner opening position, the first and second toner discharging ports 49, 55 are in the opposed state. That is, in the toner cartridge housing chamber 71 in which the shutter 111 is at the development opening position and the toner cartridge 40 in which the inner case 42 is at the toner opening position, the though hole 112 and the toner introduction port 88 oppose to the first and second toner discharging ports 49, 55. Therefore, the interior of the inner case 42 of the toner cartridge 40 communicates with that of the developing chamber 72 of the developing case 62 through the toner introduction port 88, the through hole 112, and the first and second toner discharging ports 49, 55.

Incidentally, the interface between the outer case 41 in which the first toner discharging port 49 is formed, and the inner case 42 in which the second toner discharging port 55 is formed is maintained air-tightly and liquid-tightly by the first radial projection 48, and the seal member 125 is interposed between the shutter 111 in which the through hole 112 is formed, and the curved wall 122 in which the toner introduction port 88 is formed. Therefore, the toner is prevented from leaking to the outside from the toner introduction port 88, the through hole 112, and the first and second toner discharging ports 49, 55.

When the lever gripping portion 110 is swung in accordance with the swinging of the opening/closing lever 113 from the canceling position to the abutting position as described above, the abutting portions 143 of the abutting projections 141 of the lever gripping portion 110 pass over the guide faces 146 of the abutted members 142, and then are upward swung along the abutted faces 147 to override the plural abutted portions 144.

The abutting portions 143 have a substantially convex shape. The abutted portions 144 have a substantially convex shape. Thus, when the abutting portions 143 override the abutted portions 144, vibrations are produced and applied to the inner peripheral wall 51 of the inner case 42 and the shutter 111. Herein, the abutting portions 143 and the abutted portions 144 function as a vibration applying unit.

When the swinging of the opening/closing lever 113 to the abutting position is completed, the abutting portions 143 of the lever gripping portion 110 are fitted into the abutted portions 144 at the uppermost position. At this time, the abutting portions 143 abut (referred to as "abut" in distinction from "contact" at the canceling position) from a front side (the downstream side in the direction along which the toner cartridge 40 is detached from the developing case 62) against the abutted members 142 and the abutted portions 144. The abutting portions 143 abut against the abutted members 142 and the abutted portions 144 at a contact pressure higher than that exerted when the opening/closing lever 113 is at the canceling position (see FIG. 10B).

(b-5-ii) Detachment of Toner Cartridge from Process Cartridge

In the state where the shutter 111 is at the development opening position and the inner case 42 is at the toner opening position (see FIG. 3), when the guide lever 44 is gripped and downward twisted to be swung, the inner case 42 is swung from the toner opening position (see FIG. 3) to the toner closing position (see FIG. 9). Therefore, as shown in FIG. 9, the first toner discharging port 49 of the outer peripheral wall 45 of the outer case 41 is closed by the portion of the inner peripheral wall 51 of the inner case 42 other than the second toner discharging port 55 to hermetically seal the interiors of the outer and inner cases 41, 42. Moreover, the second and third radial projections 57, 63 are swung in conjunction with the swinging of the inner case 42. Therefore, the shutter 111 which s clamped between the second and third radial projections 57, 63 is swung from the development opening position to the development closing position. As a result, the toner introduction port 88 of the toner cartridge housing chamber 71 is closed by a portion of the shutter 111 other than the through hole 112. In this way, the operation of closing the toner introduction port 88 by the shutter 111 is performed through the operation in which the first toner discharging port 49 is closed by the inner case 42.

Also the interlocking hook 18 is swung together with the guide lever 44 and the inner case 42. Then, the opening/closing lever 113 in which the grip portion 118 is engaged with the interlocking hook 18 is swung from the abutting position to the canceling position (see FIG. 2) in conjunction with the swinging of the interlocking hook 18 and the guide lever 44. In this way, the swinging operation of the opening/closing lever 113 is interlocked with the closing operations of the inner case 42 and the shutter 111.

In accordance with the swinging of the opening/closing lever 113 to the canceling position, the lever gripping portion 110 is downward swung. Therefore, as shown in FIG. 10B, the abutting portions 143 of the lever gripping portion 110 are downward swung along the abutted face 147 while the projections override the plural butted portions 144. When the abutting portions 143 override the butted portions 144, the above-described vibrations are produced. When the swinging of the opening/closing lever 113 to the canceling position is completed, the abutting portions 143 are opposed to and slightly contacted with the corresponding guide faces 146.

When the opening/closing lever 113 is at the canceling position, the abutting state of the abutting portions 143 against the abutted members 142 is canceled.

In a state where the opening/closing lever 113 is swung to the canceling position, the engaging portion 133 of the toner cartridge 40 is engaged with the engaged portion 124 of the toner cartridge housing chamber 71 as shown in FIG. 9. Further, the interlocking hook 18 is engaged with the grip portion 118 of the opening/closing lever 113, and the second radial projections 57 are engaged with the engaged portions 139 of the shutter 111. While maintaining the guide lever 44 to be gripped, the guide lever 44 is pulled in the forward and obliquely upward direction. As a result, the engagement between the engaging portion 133 and the engaged portion 124 is canceled, that between the interlocking hook 18 and the opening/closing lever 113 is canceled, the engagements between the second radial projections 57 and the engaged portions 139 are canceled, and the toner cartridge 40 is pulled out toward the forward and obliquely upward side. At this time, the positioning projections 131 (see FIG. 6) of the toner cartridge 40 are guided by the guide grooves 119 (see FIG. 6) in the toner cartridge housing chamber 71.

When the positioning projections 131 are disengaged from the guide grooves 119 as shown in FIG. 8, the operation of detaching the toner cartridge 40 from the developing case 62 of the process cartridge 20 is completed.

(b-6) Developing and Transferring Operations

As described in above-described (b-5-i) and as shown in FIG. 3, the toner cartridge 40 is attached to the developing case 62 of the process cartridge 20 to be housed in the toner cartridge housing chamber 71. When an image forming process is performed by the laser printer 1, a driving force from a motor (not shown) is applied to the agitator rotation shaft 53. Then, the agitator rotation shaft 53 is rotated in a clockwise direction in a left side view, and the agitator 56 is circumferentially moved in the inner case 42 of the toner cartridge 40, about the agitator rotation shaft 53. As a result, the toner in the toner cartridge 40 is stirred by the agitator 56, and discharged into the developing chamber 72 of the developing case 62 through the second toner discharging port 55, the first toner discharging port 49, the through hole 112, and the toner introduction port 88.

The toner which is discharged into the developing chamber 72 through the toner introduction port 88 is supplied to the developing roller 104 by the rotation of the supplying roller 101. At this time, the toner is frictionally charged to the positive polarity between the supplying roller 101 and the developing roller 104. In accordance with the rotation of the developing roller 104, the toner which is supplied onto the developing roller 104 enters between the pressing portion 148 of the layer-thickness restricting blade 107 and the developing roller 104, and carried as a thin layer of a constant thickness on the developing roller 104.

In accordance with the rotation of the photosensitive drum 28, the surface of the photosensitive drum 28 is first uniformly charged to the positive polarity by the scorotron charging device 29, and then exposed by high speed scanning of the laser beam from the scanner portion 19, so that an electrostatic latent image corresponding to an image to be formed on the sheet 3 is formed.

Next, the rotation of the developing roller 104 causes the toner which is carried on the developing roller 104, and which is charged to the positive polarity, to be opposed and contacted to the photosensitive drum 28. At this time, the toner is supplied to the electrostatic latent image formed on the surface of the photosensitive drum 28. Therefore, the electrostatic latent image on the photosensitive drum 28 is converted to a visible image, so that a toner image formed by reversal development is carried on the surface of the photosensitive drum 28.

During a period when the sheet 3 conveyed by the registering roller 15 (see FIG. 1) is passed through the transferring position between the photosensitive drum 28 and the transfer roller 31, the toner image carried on the surface of the photosensitive drum 28 is then transferred to the sheet 3 by a transfer bias applied to the transfer roller 31. The sheet 3, onto which the toner is transferred, is conveyed to the fixing portion 21.

(c) Fixing Portion

As shown in FIG. 1, the fixing portion 21 is disposed behind the process cartridge 20. The fixing portion 21 is placed while forming a gap in the forward and rearward direction between the portion and the photosensitive drum 28 of the process cartridge 20. The fixing portion 21 includes a heating roller 60 and a pressurizing roller 61.

In the fixing portion 21, the toner image transferred onto the sheet 3 at the transferring position is thermally fixed during a period when the sheet 3 is passed through between the heating roller 60 and the pressurizing roller 61. The sheet 3 onto which the toner image is fixed is conveyed to a discharge-side conveying path to be conveyed by a conveying roller 155 toward a discharging roller 47, and then discharged by the discharging roller 47 onto a discharge tray 58. The discharge tray 58 is formed on the upper face of the body casing 2.

In the process cartridge 20, as shown in FIG. 3, the opening/closing lever 113 swingably disposed in the developing case 62 abuts against the toner cartridge 40 from the downstream side (front side) in the direction along which the toner cartridge 40 is detached from the developing case 62. Therefore, even when a force of moving the toner cartridge 40 in the detaching direction (front side) is applied to the toner cartridge 40, the relative forward movement of the toner cartridge 40 with respect to the developing case 62 can be restricted. Accordingly, the state of attaching the toner cartridge 40 to the developing case 62 can be surely maintained.

The process cartridge 20 includes the guide lever 44 which is swingably disposed on the toner cartridge 40 and the interlocking hook 18 which swings the opening/closing lever 113 in conjunction with the swinging operation of the guide lever 44. According thereto, in the case where the toner cartridge 40 is attached to the developing case 62 while gripping the guide lever 44, even when the opening/closing lever 113 is not newly gripped, the swinging operation of the gripped guide lever 44 can swing the opening/closing lever 113 together. Accordingly, the opening/closing lever 113 can be abutted against the toner cartridge 40 from the front side.

As a result, the state of attaching the toner cartridge 40 to the developing case 62 can be surely maintained by a simple operation.

The opening/closing lever 113 can be swung between the abutting position (see FIG. 3) where the lever abuts against the toner cartridge 40 attached to the developing case 62, and the canceling position (see FIG. 9) where the abutting against the toner cartridge 40 is canceled. Therefore, when the opening/closing lever 113 is located at the abutting position, the state of attaching the toner cartridge 40 to the developing case 62 can be surely maintained by a simple operation of swinging the opening/closing lever 113. In contrast, when the opening/closing lever 113 is located at the canceling position, the maintenance of the attached state is cancelled, and the toner cartridge 40 can be attached to or detached from the developing case 62.

Since the guide lever 44 and the interlocking hook 18 are integrally disposed, the number of components can be reduced.

When the inner case 42 is open-operated to open the first toner discharging port 49 and the shutter 111 is open-operated to open the toner introduction port 88, the first toner discharging port 49 communicates with the toner introduction port 88. Therefore, the toner can be supplied from the toner cartridge 40 to the developing case 62. In contrast, as shown in FIG. 9, when the inner case 42 is close-operated to close the first toner discharging port 49 and the shutter 111 is close-operated to close the toner introduction port 88, the supply of the toner from the toner cartridge 40 to the developing case 62 can be restricted.

Furthermore, the swinging operation of the guide lever 44 interlocks with the opening and closing operations of the inner case 42 and/or the shutter 111. When the guide lever 44 is swung, therefore, the supply of the toner from the toner cartridge 40 to the developing case 62, or restriction of the supply of the toner can be performed in addition to the maintenance of the state of attaching the toner cartridge 40 to the developing case 62, or the cancellation of the maintenance. As a result, usability can be improved.

During the swinging operation of the opening/closing lever 113, the abutting portions 143 and abutted portions 144 applies vibrations to at least the inner case 42 as shown in FIGS. 10A and 10B. Herein, the abutting portions 143 and abutted portions 144 are an example of the vibration applying unit. Therefore, when the inner case 42 is opened or closed in conjunction with the swinging operation of the opening/closing lever 113, the toner adhering to the inner case 42 (particularly, the peripheral edge of the second toner discharging port 55) can be shaken off by the vibrations. Therefore, during an operation of removing the toner cartridge 40 from the developing case 62, it is possible to the toner adhering to the inner case 42 from adhering to and contaminating the hand of the user or the like.

While the vibration applying unit is simply configured by the abutting portions 143 and abutted portions 144 which have the substantially convex or convex shape, vibrations can be surely produced. In the present aspect, the abutting portions 143 have a substantially convex shape, and the abutted portions 144 have a substantially concave shape. However, the invention is not limited. The abutting portions 143 may have a substantially concave shape, and the abutted portions 144 may have a substantially convex shape.

In the state where the toner cartridge 40 is detached from the developing case 62, even when the opening/closing lever 113 is operated, the shutter 111 can be maintained in the state where the toner introduction port 88 is closed in the developing case 62, and the inner case 42 can be maintained in the state where the first toner discharging port 49 is closed in the toner cartridge 40.

Since the guide lever 44 and the interlocking hook 18 are disposed on the inner case 42, the number of components can be reduced, and the interlocking hook 18 can surely operate in conjunction with the swinging of the guide lever 44.

As described above, the toner cartridge 40 is attachable to and detachable from the developing case 62 in the direction perpendicular to the longitudinal direction (width direction) of the developing roller 104. Accordingly, as shown in FIG. 3, the first toner discharging port 49 and the toner introduction port 88 in the state where the toner cartridge 40 is attached to the developing case 62 can be disposed so as to be opposed to the developing roller 104. Therefore, the placement positions and sizes of the first toner discharging port 49 and the toner introduction port 88 can be freely set. Accordingly, the toner can be surely supplied from the toner cartridge 40 to the developing case 62.

Since the shutter 111 is swingably supported by the both side walls (right and left side walls 69, 70) of the developing case 62, the toner introduction port 88 can be stably opened and closed. When a portion of supporting the shutter 111 is configured by the right and left side walls 69, 70, an extra mechanism is not placed in the toner introduction port 88. Therefore, in the state where the toner cartridge 40 is attached to the developing case 62, the toner cartridge 40 and the developing case 62 can be in close contact with each other. Accordingly, it is possible to prevent the toner from leaking between the toner cartridge 40 and the developing case 62. Moreover, the guide lever 44 and the interlocking hook 18 can be easily disposed.

Since the inner case 42 is swingably supported by the both side walls (outer side end walls 46) of the toner cartridge 40, the first toner discharging port 49 can be stably opened and closed. When a portion of supporting the inner case 42 is configured by the outer side end walls 46, an extra mechanism is not placed in the first toner discharging port 49. Therefore, in the state where the toner cartridge 40 is attached to the developing case 62, the toner cartridge 40 and the developing case 62 can be in close contact with each other. Accordingly, it is possible to prevent the toner from leaking between the toner cartridge 40 and the developing case 62.

When a portion of supporting the shutter 111 is configured by the right and left side walls 69, 70, a space is formed in a portion of the developing case 62 which is in the middle between the right and left side walls 69, 70. During the operations of attaching and detaching the toner cartridge 40 to and from the developing case 62, an access of the toner cartridge 40 into the developing case 62 can be easily performed.

(Modifications)

(1) Modification 1

In the above-described aspects, the process cartridge 20 integrally includes the photosensitive drum 28 and the developing roller 104, and the process cartridge 20 is detachably attached to the body casing 2. For example, the developing device may not include the photosensitive drum 28, another unit having the photosensitive drum 28 may be disposed, and the developing device may be detachably attached to the unit.

(2) Modification 2

Figure 11A:
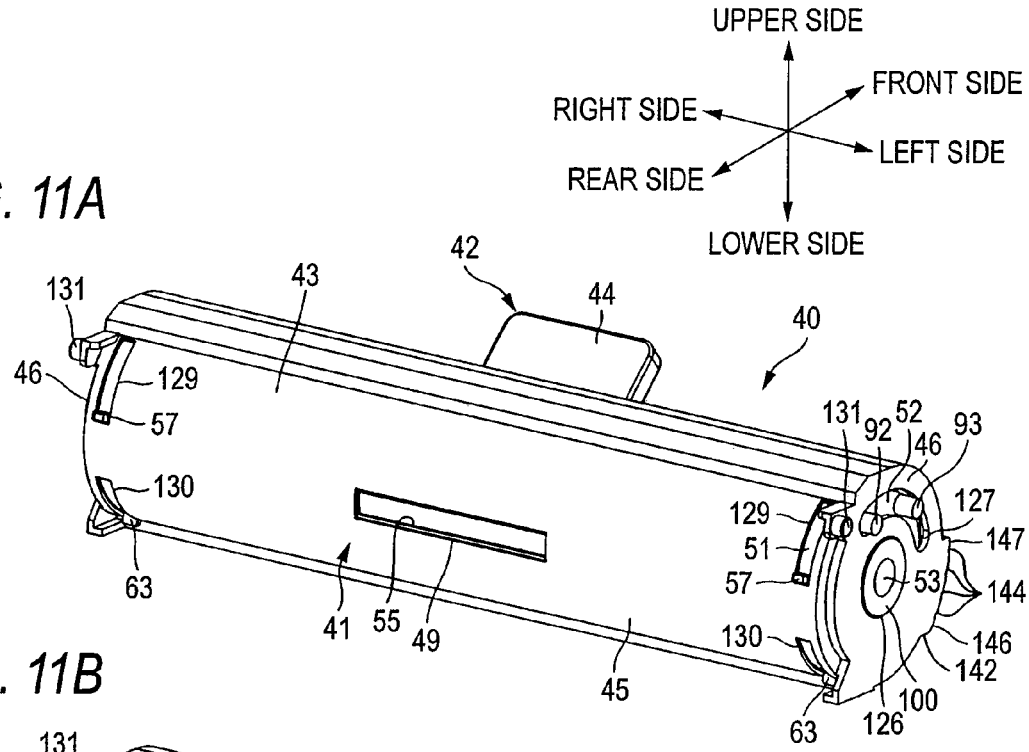
FIGS. 11A to 11C are views in which Modification 2 is applied to FIGS. 5A to 5C.
Figure 11B:
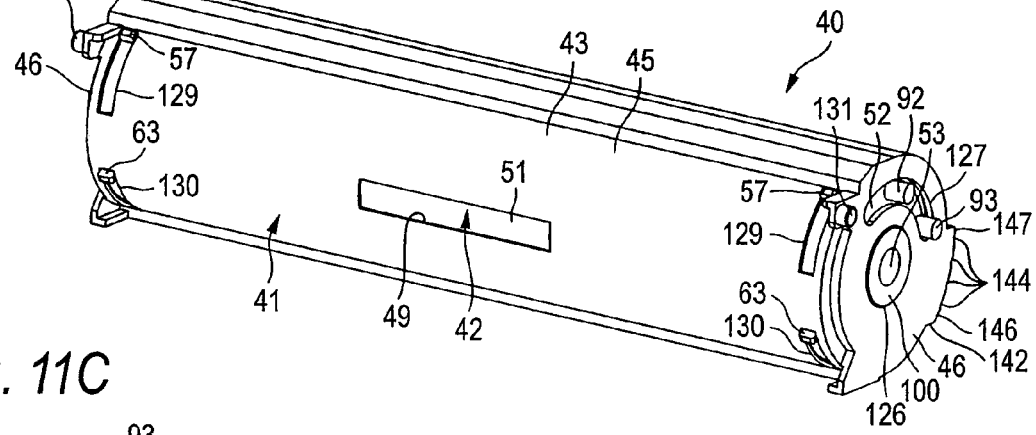
Figure 11C:
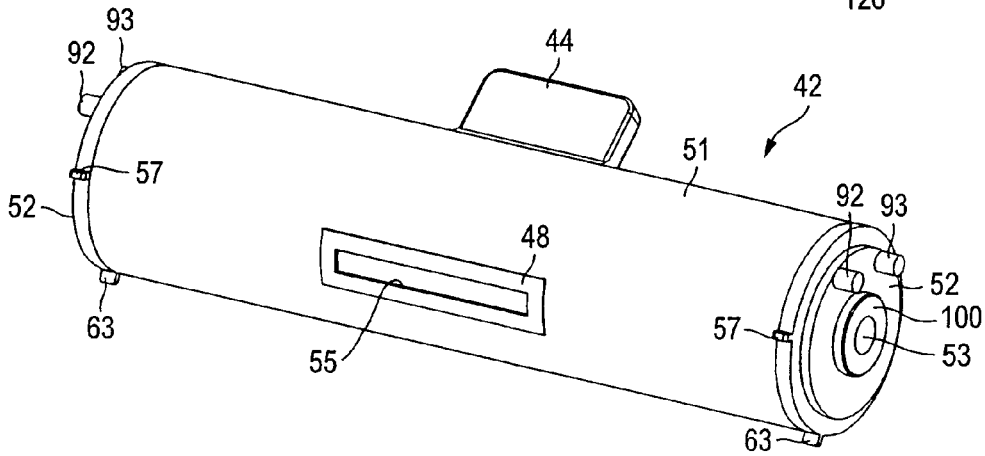
Figure 12:
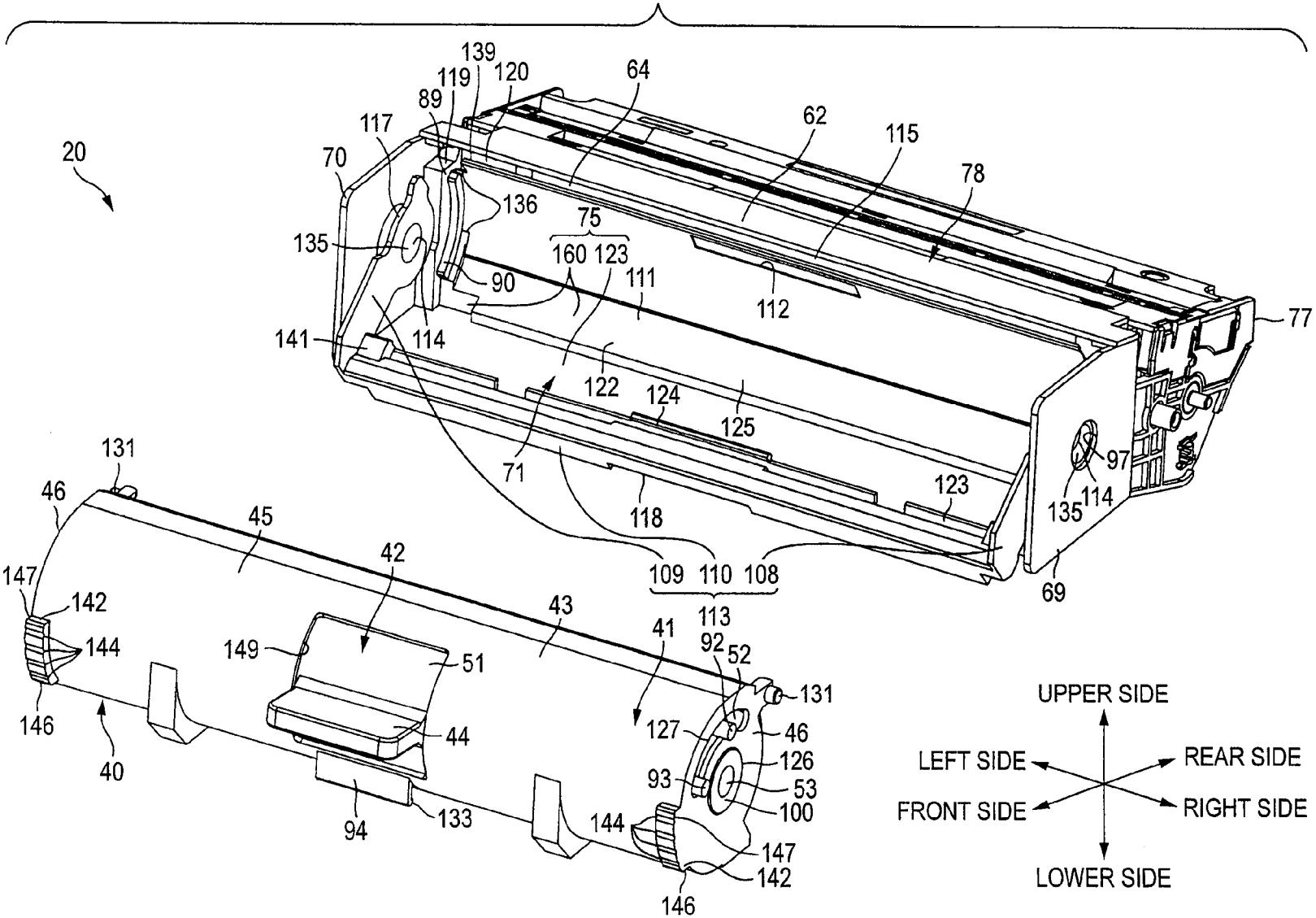
FIG. 12 is a view in which Modification 2 is applied to FIG. 6.
Figure 13:
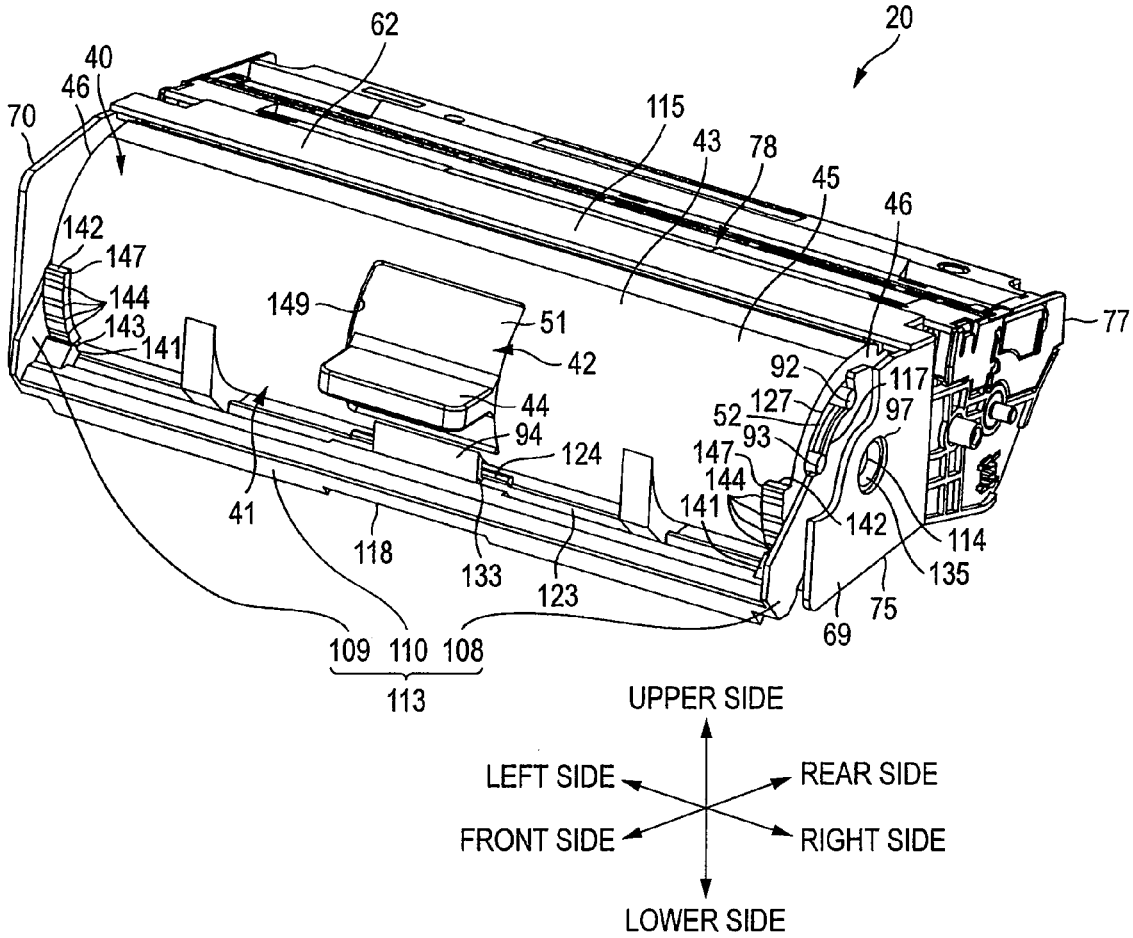
FIG. 13 is a view in which Modification 2 is applied to FIG. 7.
Figure 14:
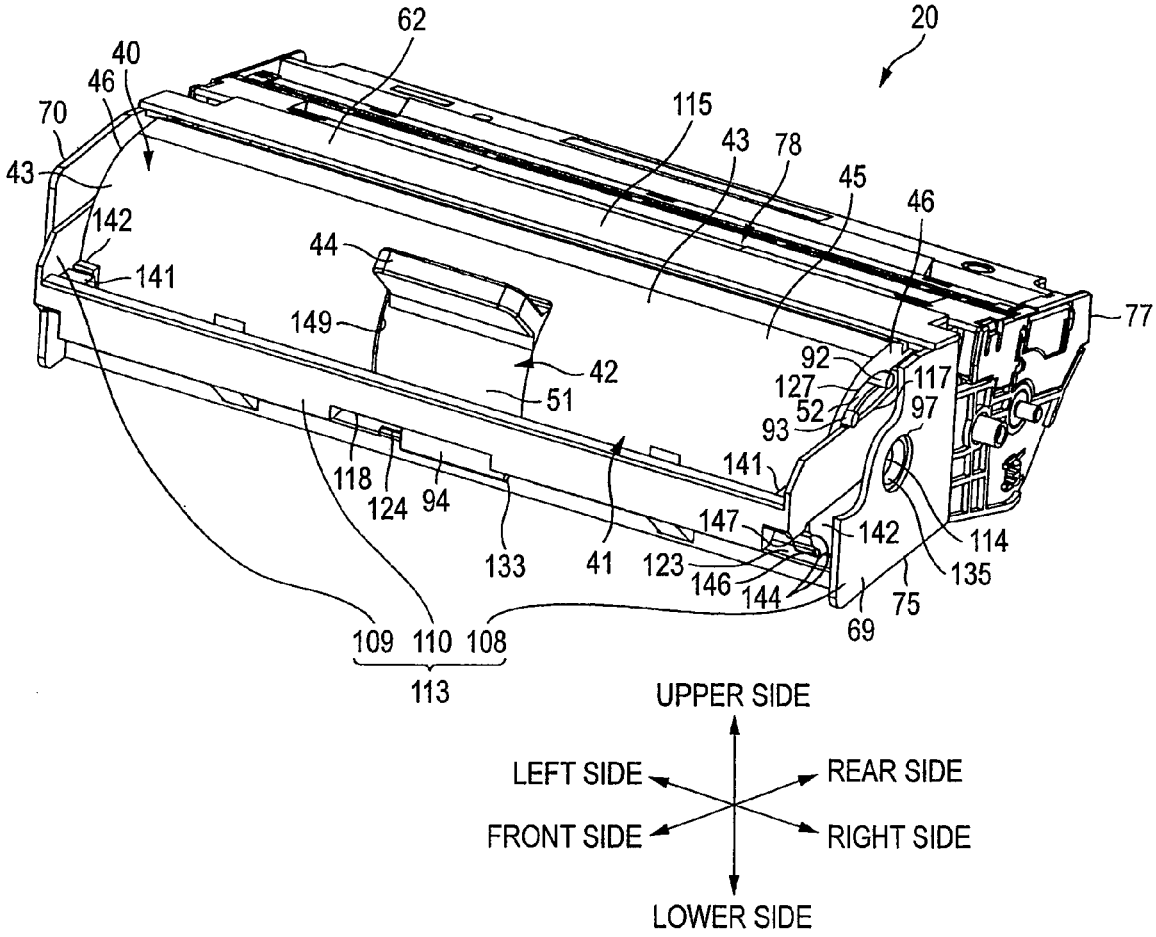
FIG. 14 is a view in which Modification 2 is applied to FIG. 2.

FIGS. 11A to 11C are views in which Modification 2 is applied to FIG. 5. FIG. 12 is a view in which Modification 2 is applied to FIG. 6. FIG. 13 is a view in which Modification 2 is applied to FIG. 7. FIG. 14 is a view in which Modification 2 is applied to FIG. 2.

In the laser printer 1, a toner cartridge 40 which is different from that in the above-described aspects can be used. Hereinafter, the toner cartridge 40 in Modification 2 will be described in detail.

As shown in FIGS. 11A to 11C, in the toner cartridge 40 in Modification 2, the inner case 42 includes first and second width-direction projections 92, 93 as an example of the interlocking member, in place of the interlocking hook 18 (see FIG. 7).

As shown in FIG. 11C, the first and second width-direction projections 92, 93 have a substantially columnar shape which is projected to the outside in the width direction at a position which is radially outside with respect to the agitator rotation shaft 53 in each of the inner side end walls 52. Specifically, the first and second width-direction projections 92, 93 are separated from each other while forming a gap therebetween in the circumferential direction of the inner peripheral wall 51 and positioned between the guide lever 44 and the second toner discharging port 55. The first width-direction projection 92 is positioned more closely (on the rear side) to the second toner discharging port 55 than the second width-direction projection 93. The first width-direction projections 92 on the inner side end walls 52 are opposed to each other in the width direction, and the second width-direction projections 93 on the inner side end walls 52 are opposed to each other in the width direction. In the above-described aspects, the guide lever 44 and the interlocking hook 18 are integrally disposed while they are coupled to each other by the coupling ribs 150 (see FIG. 2). In contrast, the first and second width-direction projections 92, 93 are disposed independently from the guide lever 44.

Corresponding to the first and second width-direction projections 92, 93, in each of the outer side end walls 46, a through groove 127 is formed on the radially outer side of the second through hole 126, specifically, in a range from the 12 o'clock position to the 2 o'clock position in a left side view, as shown in FIGS. 11A and 11B. The through grooves 127 have a substantially inferior arc shape which is concentric with the second through hole 126, and penetrate in the width direction through the respective outer side end walls 46. The circumferential length of each of the through grooves 127 is about two times the distance between the first and second width-direction projections 92, 93 in the circumferential direction, and the width of the groove is slightly larger than the radial dimensions of the first and second width-direction projections 92, 93.

In the state where the inner case 42 is housed in the outer case 41, the first and second width-direction projections 92, 93 are projected to the outside in the width direction through the corresponding through grooves 127 in the outer case 41 and slidable along the through grooves 127. When the inner case 42 is swung with respect to the outer case 41, the first and second width-direction projections 92, 93 are guided by the through grooves 127. When the inner case 42 is at the above-described toner closing position, as shown in FIG. 11B, the second width-direction projections 93 abut against the front edges of the through grooves 127. At this time, the first width-direction projections 92 are separated from the rear edges of the through grooves 127. In contrast, when the inner case 42 is at the above-described toner opening position, as shown in FIG. 11A, the first width-direction projections 92 abut against the rear edges of the through grooves 127. At this time, the second width-direction projections 93 are separated from the front edges of the through grooves 127.

Next, attachment and detachment of the toner cartridge 40 in Modification 2 to and from the developing case 62 of the process cartridge 20 will be described with reference to FIGS. 12 to 14. In FIGS. 13 and 14, for the sake of convenience of description, an upper and obliquely front portion of the right side wall 69 is cut away.

As shown in FIG. 12, similarly with the above-described aspects, the toner cartridge 40 in which the inner case 42 is at the toner closing position is attached to the toner cartridge housing chamber 71 of the developing case 62 of the process cartridge 20 in which the opening/closing lever 113 is at the canceling position.

When the positioning projections 131 abut against the innermost portions of the guide grooves 119, the first and second width-direction projections 92, 93 of the toner cartridge 40 are engaged with receiving portions 117 of the opening/closing lever 113 which is at a lever closing position as shown in FIG. 13, in place of the engagement of the interlocking hook 18 with the opening/closing lever 113 (see FIG. 7) in the above-described aspects. Specifically, the first width-direction projections 92 abut from a substantially upper side against the rear edges of the receiving portions 117, and the second width-direction projection 93 abut from a substantially upper side against the front edges of the receiving portions 117. Similarly with the above-described aspects, the outer case 41 is positioned with respect to the toner cartridge housing chamber 71, thereby completing the attachment of the toner cartridge 40 into the process cartridge 20.

Similarly with the above-described aspects, when the guide lever 44 is gripped and upward twisted, the inner case 42 is swung (see FIG. 14) from the toner closing position (see FIG. 9) to the toner opening position (see FIG. 3). Similarly with the guide lever 44, the first and second width-direction projections 92, 93 are disposed integrally with the inner case 42. Therefore, the first and second width-direction projections are swung together with the guide lever 44 and the inner case 42. The opening/closing lever 113 in which the receiving portions 117 are engaged with the first and second width-direction projections 92, 93 is swung (see FIG. 14) from the canceling position to the abutting position in accordance with the swinging of the first and second width-direction projections 92, 93. Specifically, when the swinging first width-direction projections 92 push the rear edges of the receiving portions 117 to the rear side (specifically, in a clockwise direction in a right side view), the opening/closing lever 113 is swung from the canceling position to the abutting position.

When the guide lever 44 is gripped and downward twisted, the inner case 42 is swung (see FIG. 13) from the toner opening position (see FIG. 3) to the toner closing position (see FIG. 9) similarly with the above-described aspects. Similarly with the case where the guide lever 44 is upward twisted, the first and second width-direction projections 92, 93 are swung together with the guide lever 44 and the inner case 42. The opening/closing lever 113 is swung (see FIG. 13) from the abutting position to the canceling position in accordance with the swinging of the first and second width-direction projections 92, 93. Specifically, when the swinging second width-direction projections 93 push the front edges of the receiving portions 117 to the front side (specifically, in a counterclockwise direction in a right side view), the opening/closing lever 113 is swung from the abutting position to the canceling position. Similarly with the above-described aspects, when the guide lever 44 is pulled in the forward and obliquely upward direction while maintaining the guide lever 44 to be gripped, the engagements between the first and second width-direction projections 92, 93 and the opening/closing lever 113 are canceled. When the positioning projections 131 are disengaged from the guide grooves 119, the detachment of the toner cartridge 40 from the developing case 62 of the process cartridge 20 is completed (see FIG. 12).

In the toner cartridge 40 in Modification 2, the first and second width-direction projections 92, 93 are disposed on the both sides (inner side end walls 52) of the toner cartridge 40 in the longitudinal direction (width direction) of the developing roller 104. Herein, the toner cartridge 40 is attached to and detached from the developing case 62 in the direction perpendicular to the longitudinal direction of the developing roller 104. When the first and second width-direction projections 92, 93 are disposed on the inner side end walls 52, it is possible to prevent the first and second width-direction projections 92, 93 from obstructing the operations of attaching and detaching the toner cartridge 40.

The first and second width-direction projections 92, 93 may be formed as an integral member.

What is claimed is:

1. A developing device comprising:

a developing roller that supplies developer;

a developing case that supports the developing roller;

a toner cartridge that houses the developer and is attachable to and detachable from the developing case in a direction perpendicular to a longitudinal direction of the developing roller;

an abutting member that is swingably provided on the developing case and is abuttable against the toner cartridge from a downstream side in a direction along which the toner cartridge is detached from the developing case;

an operating member that is swingably provided on the toner cartridge; and an interlocking member that swings the abutting member between a first position where the abutting member abuts against the toner cartridge provided on the developing case and a second position where the abutting of the abutting member against the toner cartridge is canceled, the interlocking member swinging in conjunction with a swinging operation of the operating member, and the toner cartridge being detachable from the developing case when the interlocking member is in the second position.

2. The developing device according to claim 1, wherein the operating member and the interlocking member are integrally provided to the toner cartridge.

3. The developing device according to claim 1, wherein the interlocking member is provided on both side walls of the toner cartridge in the longitudinal direction of the developing roller.

4. The developing device according to claim 1, wherein:

the toner cartridge comprises:

a first opening that supplies the developer to the developing case; and a first blocking member that opens and closes the first opening;

the developing case comprises:

a second opening that communicates with the first opening to receive the developer supplied from the first opening; and a second blocking member that opens and closes the second opening; and the swinging operation of the operating member interlocks with opening and closing operations of at least one of the first blocking member and the second blocking member.

5. The developing device according to claim 4, further comprising:

a vibration applying unit that applies vibrations to at least the first blocking member during a swinging operation of the abutting member.

6. The developing device according to claim 5, wherein the vibration applying unit comprises:

a first portion that has a substantially convex or concave shape in the abutting member and abuts against the toner cartridge during the swinging operation of the abutting member; and a second portion that has a substantially concave or convex shape fittable to the first portion and abuts against the first portion during the swinging operation of the abutting member.

7. The developing device according to claim 4, wherein the operations of opening and closing the second opening by the second blocking member are performed through the operations of opening and closing the first opening by the first blocking member.

8. The developing device according to claim 4, wherein the operating member and the interlocking member are provided on the first blocking member.

9. The developing device according to claim 4, wherein:

the second blocking member is swingably supported by both side walls of the developing case in the longitudinal direction of the developing roller, and the first blocking member is swingably supported in a direction perpendicular to an attaching/detaching direction of the toner cartridge, by both side walls of the toner cartridge in the longitudinal direction of the developing roller.

10. A toner cartridge attachable to or detachable from a developing device, the developing device comprising:

a developing case that supports a developing roller; and an abutting member that is swingably provided on the developing case, the toner cartridge being attachable to and detachable from the developing case, the toner cartridge comprising:

a toner case;

an operating member that is swingably provided on the toner case; and an interlocking member that swings the abutting member in conjunction with a swinging operation of the operating member so as to 15 abut the abutting member against the toner case to prevent the toner cartridge from being detached from the developing device.

11. The toner cartridge according to claim 10, wherein the operating member and the interlocking member are integrally provided to the toner cartridge.

12. The toner cartridge according to claim 10, further comprising:

an opening that supplies the developer to the developing case;

a blocking member that opens and closes the opening; and a vibration applying unit that applies vibrations to the blocking member during an opening/closing operation of the blocking member.

13. The toner cartridge according to claim 12, wherein the vibration applying unit includes an abutted portion that has a substantially convex or concave shape and abuts against the abutting member.

14. The toner cartridge according to claim 12, wherein the operating member and the interlocking member are provided on the blocking member.

15. The toner cartridge according to claim 12, wherein:

the toner cartridge is attachable to and detachable from the developing case in a direction perpendicular to a longitudinal direction of the developing roller, and the blocking member is swingably supported in a direction perpendicular to an attaching/detaching direction of the toner cartridge, by both side walls of the toner cartridge in the longitudinal direction of the developing roller.

* * * * *